US009296456B2

(12) United States Patent
Mochizuki et al.

(10) Patent No.: US 9,296,456 B2
(45) Date of Patent: Mar. 29, 2016

(54) MARINE VESSEL

(71) Applicant: Yamaha Hatsudoki Kabushiki Kaisha, Iwata-shi, Shizuoka (JP)

(72) Inventors: Yasushi Mochizuki, Shizuoka (JP); Yoshifumi Nakazono, Shizuoka (JP); Hirohide Ihara, Shizuoka (JP); Takayuki Moue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 32 days.

(21) Appl. No.: 14/454,800

(22) Filed: Aug. 8, 2014

(65) Prior Publication Data

US 2014/0349530 A1 Nov. 27, 2014

Related U.S. Application Data

(63) Continuation of application No. 13/260,992, filed as application No. PCT/JP2010/000116 on Jan. 12, 2010, now Pat. No. 8,826,845.

(30) Foreign Application Priority Data

Mar. 30, 2009 (JP) ..... 2009-082053
Oct. 30, 2009 (JP) ..... 2009-250174

(51) Int. Cl.
*B63H 5/20* (2006.01)
*B63H 5/125* (2006.01)
*B63H 20/08* (2006.01)
(Continued)

(52) U.S. Cl.
CPC *B63H 20/10* (2013.01); *B63B 3/48* (2013.01); *B63B 19/14* (2013.01); *B63H 5/125* (2013.01); *B63H 20/04* (2013.01); *B63H 20/08* (2013.01); *B63H 20/22* (2013.01); *B63B 29/02* (2013.01);
(Continued)

(58) Field of Classification Search
CPC ..... B63B 3/48; B63B 19/14; B63B 29/02; B63B 2003/485; B63B 2029/043; B63H 5/125; B63H 20/04; B63H 20/08; B63H 20/10; B63H 20/22
USPC ..... 114/56.1, 61.2, 61.31, 362, 364, 65 R, 114/78, 85, 116, 117, 201 R; 440/49, 53, 54, 440/55
See application file for complete search history.

(56) References Cited

U.S. PATENT DOCUMENTS 2,718,206 A * 9/1955 Camp ..... B63H 20/04 114/127
2,764,119 A * 9/1956 Sigler ..... B63B 25/08 248/641

(Continued)

OTHER PUBLICATIONS

Mochizuki et al.; "Marine Vessel"; U.S. Appl. No. 13/260,992, filed Sep. 29, 2011, Parent application docket DVV.

*Primary Examiner* — Daniel V Venne
(74) *Attorney, Agent, or Firm* — Keating and Bennett, LLP

(57) ABSTRACT

A marine vessel includes an outboard motor mounting portion provided at a stern of a hull, an outboard motor locating hole provided rearward of the outboard motor mounting portion and near the outboard motor mounting portion and penetrating vertically through the stern, a platform provided rearward of the outboard motor locating hole, and an outboard motor located in the outboard motor locating hole and mounted to the outboard motor mounting portion. This structure enables an occupant of the marine vessel to freely move in a space around the outboard motor on the platform and use the space.

9 Claims, 25 Drawing Sheets

(51) Int. Cl.

| | |
|---|---|
| ***B63H 20/10*** | (2006.01) |
| ***B63B 3/48*** | (2006.01) |
| ***B63H 20/04*** | (2006.01) |
| ***B63B 19/14*** | (2006.01) |
| ***B63H 20/22*** | (2006.01) |
| *B63B 29/02* | (2006.01) |
| *B63B 29/04* | (2006.01) |

(52) U.S. Cl.
CPC ..... *B63B 2003/485* (2013.01); *B63B 2029/043* (2013.01)

(56) References Cited

U.S. PATENT DOCUMENTS 2,842,086 A * 7/1958 Yost ..... B63B 25/08 248/641
3,010,422 A * 11/1961 Brakensiek ..... B63H 5/07 440/88 G
3,019,755 A * 2/1962 Diamond ..... B63B 1/20 114/274
3,241,511 A * 3/1966 Drtina ..... B63B 1/28 114/279
3,938,458 A * 2/1976 Irgens ..... B63H 9/1035 114/106
3,943,586 A * 3/1976 Palmer ..... B63B 3/09 114/179
4,302,195 A * 11/1981 Bryant ..... B63H 20/10 248/640
4,708,087 A * 11/1987 Potter, Jr. ..... B63H 20/06 114/343
4,823,725 A * 4/1989 Smith ..... B63H 20/06 114/343
5,293,832 A * 3/1994 Potter, Jr. ..... B63H 20/06 114/343
6,497,594 B1 * 12/2002 Towner ..... B63H 5/125 440/53
6,561,859 B1 * 5/2003 Towner ..... B63H 20/04 440/112
6,609,939 B1 * 8/2003 Towner ..... B63H 5/125 440/111
7,064,584 B2 * 6/2006 Bertram ..... H03K 19/0963 326/121
7,407,419 B2 * 8/2008 Douglas ..... B63H 20/106 248/640

* cited by examiner

MARINE VESSEL

BACKGROUND OF THE INVENTION

1. Field of the Invention

The present invention relates to a marine vessel that is propelled by an outboard motor.

2. Description of the Related Art

So-called cruiser type marine vessels to be used for leisure, etc., are known. An example of such marine vessels is a marine vessel that is propelled by an outboard motor (for example, refer to Japanese Published Unexamined Patent Application No. H09-207888). This marine vessel is propelled by an outboard motor disposed outside the hull, so that a space for locating a driving engine is not necessary inside the hull. Therefore, in the marine vessel, a space for installing various devices and a space for relaxing are wider than in other types of marine vessels with substantially the same size.

A marine vessel according to the above-described prior art has an outboard motor mounting portion provided on the transom. An outboard motor provided in the marine vessel is mounted to the outboard motor mounting portion. The upper side, the front side, and both left and right sides of the outboard motor are covered by an outboard motor cover. The marine vessel has stern steps provided, respectively, on the left and right sides of the outboard motor and arranged to allow an occupant to sit thereon. The outboard motor cover cuts off noise of the outboard motor, and is used as a table.

However, in the marine vessel according to the above-described prior art, no aisle connecting the stern steps disposed on the left and right sides of the outboard motor is provided. Therefore, for example, when an occupant moves from one stern step to the other stern step, the occupant must move from one stern step to a deck and then move from the deck to the other stern step.

In addition, in the marine vessel according to the above-described prior art, an outboard motor is mounted to an outboard motor mounting portion provided on the transom. Therefore, the space between the transom and the outboard motor becomes narrow. Therefore, a flow of water flowing from a water drain surface of the lower portion of the transom is directly caught by a propeller of the outboard motor and air drawing (bubble biting) easily occurs.

SUMMARY OF THE INVENTION

Preferred embodiments of the present invention provide a marine vessel in which an occupant can freely move around an outboard motor and having an improved running performance.

A marine vessel according to a preferred embodiment of the present invention includes an outboard motor mounting portion provided at a stern of a hull, an outboard motor locating hole provided rearward of the outboard motor mounting portion and near the outboard motor mounting portion and penetrating vertically through the stern, a platform provided rearward of the outboard motor locating hole, and an outboard motor located in the outboard motor locating hole and mounted to the outboard motor mounting portion.

With this arrangement of the present preferred embodiment of the present invention, the outboard motor locating hole penetrating vertically through the stern of the hull is provided near the rear side of the outboard motor mounting portion. The outboard motor is located in the outboard motor locating hole, and mounted to the outboard motor mounting portion. Further, the platform is provided rearward of the outboard motor locating hole. Therefore, an occupant can freely move in a space around the outboard motor on the platform and freely and fully use the space. The outboard motor is surrounded by the platform and the hull so that when the stern of the marine vessel is caused to come alongside the pier, etc., or an object collides with the marine vessel from the rear side, the outboard motor is protected by the platform and the hull. Accordingly, the outboard motor is prevented from being broken or damaged.

It is preferable that the platform includes a notched hole extending rearward from the outboard motor locating hole and penetrating vertically through the platform, and the outboard motor is arranged to be turnable around a horizontal axis passing through the front portion of the outboard motor until a lower portion of the outboard motor reaches a position above the platform through the notched hole.

With this arrangement of the present preferred embodiment of the present invention, the outboard motor is arranged to be turnable around the horizontal axis. When the outboard motor is turned around the horizontal axis and the lower portion of the outboard motor moves up (the outboard motor is tilted up), the lower portion of the outboard motor moves to a position above the platform through the notched hole. Therefore, the outboard motor is prevented from colliding with the platform. Further, an increase in length in the front-rear direction of the outboard motor locating hole is prevented. Accordingly, the space that an occupant can freely use in the marine vessel is increased.

It is preferable that the notched hole has a length in a right-left direction that is shorter than a length of the outboard motor locating hole in the right-left direction.

With this arrangement of the present preferred embodiment of the present invention, the space that an occupant can freely use in the marine vessel is increased.

It is preferable that the notched hole is arranged to have a size necessary and sufficient to allow the lower portion of the outboard motor to pass through.

It is preferable that the marine vessel further includes a first water drain surface disposed forward of the outboard motor mounting portion on the bottom portion of the hull, and a pair of extending portions extending in the front-rear direction on the right and left of the outboard motor locating hole and each including a second water drain surface provided on the rear portion thereof.

With this arrangement of the present preferred embodiment of the present invention, the first water drain surface is disposed forward of the outboard motor mounting portion. Therefore, the distance between the first water drain surface and the outboard motor increases by an amount corresponding to at least the outboard motor mounting portion. Air drawing easily occurs when the distance between the first water drain surface and the outboard motor is short. Therefore, occurrence of air drawing is prevented. Accordingly, the acceleration performance of the marine vessel is improved.

In addition, a pair of extending portions is provided on the bottom portion of the hull. In detail, portions positioned on both sides of the outboard motor mounting portion on the bottom portion of the hull are extended to the stern side. Therefore, buoyancy of the marine vessel increases. Therefore, even when an occupant moves on the platform while the marine vessel is moored, changes in posture of the marine vessel are prevented.

Two second water drain surfaces preferably are provided on the rear portions of the pair of extending portions. The running speed of the marine vessel depends on the distance between the center of gravity of the hull and the water drain surfaces. Further, as the distance between the center of gravity of the hull and the water drain surfaces becomes longer, the restoring force of the marine vessel during running increases.

Therefore, the distance between the center of gravity of the hull and the water drain surfaces (second water drain surfaces) is increased, so that high-speed running with high restoring force is realized.

The marine vessel preferably includes at least three water drain surfaces (the first water drain surface and the two second water drain surfaces). The two second water drain surfaces are disposed at different positions in the right-left direction of the marine vessel with respect to the first water drain surface. Further, the two second water drain surfaces are disposed rearward of the first water drain surface. Therefore, the distance between the center of gravity and the water drain position in the front-rear direction of the marine vessel is increased. Accordingly, the acceleration performance of the marine vessel is improved.

It is preferable that the marine vessel further includes a ceiling portion that is disposed above the outboard motor locating hole and covers the outboard motor.

With this arrangement of the present preferred embodiment of the present invention, objects and persons can be prevented from falling into the outboard motor locating hole by the ceiling portion. Further, an occupant can effectively use the upper surface of the ceiling portion as, for example, a table. Accordingly, the space that an occupant can use in the marine vessel is increased.

The ceiling portion may simply cover the outboard motor, or may be arranged to function as a table or a chair.

It is preferable that the platform includes an upper portion configured in a stepped manner so as to become higher in a forward direction thereof.

It is preferable that the height of the higher portion (for example, the front portion) of the platform is set to be substantially equal to the height of the pier that the marine vessel is caused to come alongside. It is preferable that the height of the lower portion (for example, the rear portion) of the platform is set to be slightly higher than the water surface. In this case, by using the front portion of the platform as a step by an occupant to get on and off the marine vessel from the pier, getting on/off the marine vessel from the pier becomes easy. Also, by using the rear portion of the platform as a step by an occupant to move between the marine vessel and the water when the occupant swims, movement between the marine vessel and the water becomes easy. Further, the upper portion of the platform is configured in a stepped manner so as to become higher in a forward direction thereof, so that at least one step is provided on the upper portion of the platform. This step can hold back water entering from the rear portion of the platform. Accordingly, entering of water to the inside of the marine vessel is prevented.

It is preferable that the outboard motor is arranged to be turnable to the left and right around a steering axis passing through the front portion of the outboard motor, and the length in the right-left direction of the notched hole is set to allow the lower portion of the outboard motor to pass through the notched hole in a state in which the outboard motor is turned to an arbitrary steering angle (arbitrary steering angle within the whole steering angle range) around the steering axis.

With this arrangement of the present preferred embodiment of the present invention, even when the outboard motor is turned around the horizontal axis in a steered state, the lower portion of the outboard motor passes through the notched hole without colliding with the platform. Therefore, an occupant can turn the outboard motor around the horizontal axis until the lower portion of the outboard motor reaches a position above the platform without an operation of returning the outboard motor to a steering origin. Therefore, the convenience is improved.

It is preferable that the marine vessel includes a hatch that closes the notched hole and a joint member that joins the hatch to the platform in such a manner that the hatch is openable.

With this arrangement of the present preferred embodiment of the present invention, the notched hole is closed by the hatch. An occupant can freely use the space on the hatch. Therefore, the space that an occupant can use in the marine vessel is increased. The hatch is joined to the platform openably and closably by the joint member. Therefore, when the hatch is opened, the hatch does not become an obstacle when the outboard motor is turned around the horizontal axis.

The hatch may be arranged to be manually openable and closable, or may be arranged to be automatically openable and closable. Alternatively, the hatch may be arranged so that only the opening operation or the closing operation of the hatch is automatic.

It is preferable that the hatch is arranged so that at least a portion of the upper surface of the hatch is positioned to be flush with the upper surface of the platform in a state in which the hatch is closed.

With this arrangement of the present preferred embodiment of the present invention, a flat wide space is provided by the upper surface of the platform and at least a portion of the upper surface of the hatch. An occupant can smoothly move in this wide space. Therefore, a highly-convenient wide space is secured at the rear portion of the marine vessel.

It is preferable that the marine vessel further includes a tilt detection mechanism that detects a tilting state of the outboard motor, an opening/closing sensor that detects opening/closing of the hatch, and a control device that receives detection values of the tilt detection mechanism and the opening/closing sensor and controls the outboard motor based on these detection values. In this case, it is preferable that the control device is arranged to stop turning of the outboard motor when the lower portion of the outboard motor reaches a position adjacent to the notched hole in a state in which the hatch is not opened when the lower portion of the outboard motor is moved upward by turning the outboard motor.

With this arrangement of the present preferred embodiment of the present invention, the control device detects a tilting state of the outboard motor based on a detection value of the tilt detection mechanism. Further, the control device detects opening/closing of the hatch based on a detection value of the opening/closing sensor. Further, in a case where the lower portion of the outboard motor is moved upward by turning the outboard motor around the horizontal axis, unless the hatch is opened, the control device stops turning of the outboard motor when the lower portion of the outboard motor reaches a position adjacent to the notched hole. Accordingly, the hatch and the outboard motor are prevented from being broken or damaged by a collision with the outboard motor.

The tilt detection mechanism may detect a tilt angle (position) of the outboard motor or may detect which region the outboard motor is positioned in of the tilting range of the outboard motor. The opening/closing sensor may detect a position of the hatch in the opening/closing direction, or may detect whether the hatch is at an opening position or a closing position.

It is preferable that the marine vessel further includes a tilt detection mechanism that detects a tilting state of the outboard motor, an opening/closing sensor that detects opening/closing of the hatch, an opening mechanism that includes an opening actuator that opens the hatch and moves the hatch in a direction in which the hatch opens, and a control device that receives detection values of the tilt detection mechanism and the opening/closing sensor and controls the outboard motor and the opening actuator based on these detection values. In this case, it is preferable that the control device is arranged to perform an opening/closing detection step of detecting whether the hatch is opened before the lower portion of the outboard motor passes through the notched hole based on detection values of the tilt detection mechanism and the opening/closing sensor when the outboard motor is turned until the lower portion of the outboard motor moves to a position above the platform, an opening step of opening the hatch before the lower portion of the outboard motor passes through the notched hole by controlling the opening actuator when the hatch is not opened in the opening/closing detection step, and a moving-up step of making the lower portion of the outboard motor pass through the notched hole in a state in which the hatch is opened.

With this arrangement of the present preferred embodiment of the present invention, the control device performs the opening/closing detection step when the outboard motor is turned until the lower portion of the outboard motor moves to a position above the platform. Specifically, the control device detects whether the hatch is opened before the lower portion of the outboard motor passes through the notched hole based on detection values of the tilt detection mechanism and the opening/closing sensor. Further, the control device performs the opening step when the hatch is not opened in the opening/closing detection step. Specifically, the control device opens the hatch before the lower portion of the outboard motor passes through the notched hole by controlling the opening actuator. Then, by performing the moving-up step, the control device makes the lower portion of the outboard motor pass through the notched hole in a state in which the hatch is opened. Accordingly, the lower portion of the outboard motor is moved to a position above the platform without colliding with the hatch. Thus, with this arrangement of the present preferred embodiment of the present invention, the hatch is automatically opened, so that a high level of convenience is obtained. Further, the hatch is opened before the lower portion of the outboard motor passes through the notched hole, so that the outboard motor is reliably prevented from colliding with the hatch. Accordingly, the hatch and the outboard motor are prevented from being broken or damaged. It is preferable that the control device is arranged to further perform a stopping step of stopping turning of the outboard motor when the lower portion of the outboard motor reaches a position adjacent to the notched hole in a state in which the hatch is not opened when the lower portion of the outboard motor is moved upward by turning the outboard motor, and performs the opening/closing detection step and the opening step in the state in which turning of the outboard motor is stopped in the stopping step.

With this arrangement of the present preferred embodiment of the present invention, in a case where the lower portion of the outboard motor is moved upward by turning the outboard motor, the control device performs the stopping step when the hatch is not opened. Specifically, the control device stops turning of the outboard motor when the lower portion of the outboard motor moves to a position just in front of the notched hole. Then, the control device performs the opening/closing detection step and the opening step in the state in which turning of the outboard motor is stopped in the stopping step. Specifically, the control device detects opening/closing of the hatch in the state in which the lower portion of the outboard motor is stopped just in front of the notched hole. When the hatch is not opened, the control device opens the hatch by controlling the opening actuator in a state in which the lower portion of the outboard motor is stopped just in front of the notched hole. Accordingly, the hatch and the outboard motor are reliably prevented from being broken or damaged by a collision with the outboard motor.

It is preferable that the marine vessel further includes a closing mechanism that includes a closing actuator that closes the hatch and moves the hatch in a direction in which the hatch closes. In this case, it is preferable that the control device is arranged to perform a moving-down step of making the lower portion of the outboard motor pass through the notched hole in a state in which the hatch is opened when the outboard motor is turned until the lower portion of the outboard motor moves from a position above the platform to a position below the platform, a passage detection step of detecting passage of the lower portion of the outboard motor through the notched hole based on a detection value of the tilt detection mechanism in the moving-down step, and a closing step of closing the hatch by controlling the closing actuator after passage of the lower portion of the outboard motor through the notched hole is detected in the passage detection step.

With this arrangement of the present preferred embodiment of the present invention, the control device performs the moving-down step when the outboard motor is turned until the lower portion of the outboard motor moves from a position above the platform to a position below the platform. Specifically, the control device makes the lower portion of the outboard motor pass through the notched hole in the state in which the hatch is opened. Then, the control device detects passage of the lower portion of the outboard motor through the notched hole based on a detection value of the tilt detection mechanism in the moving-down step by performing the passage detection step. At this time, when passage of the lower portion of the outboard motor through the notched hole is detected, the control device performs the closing step after the passage is detected. Specifically, the control device closes the hatch by controlling the closing actuator. Thus, with this arrangement of the present preferred embodiment of the present invention, the hatch is automatically closed, so that a high level of convenience is obtained. Further, the hatch is closed after the lower portion of the outboard motor passes through the notched hole, so that the hatch is reliably prevented from colliding with the lower portion of the outboard motor. Accordingly, the hatch and the outboard motor are prevented from being broken or damaged.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
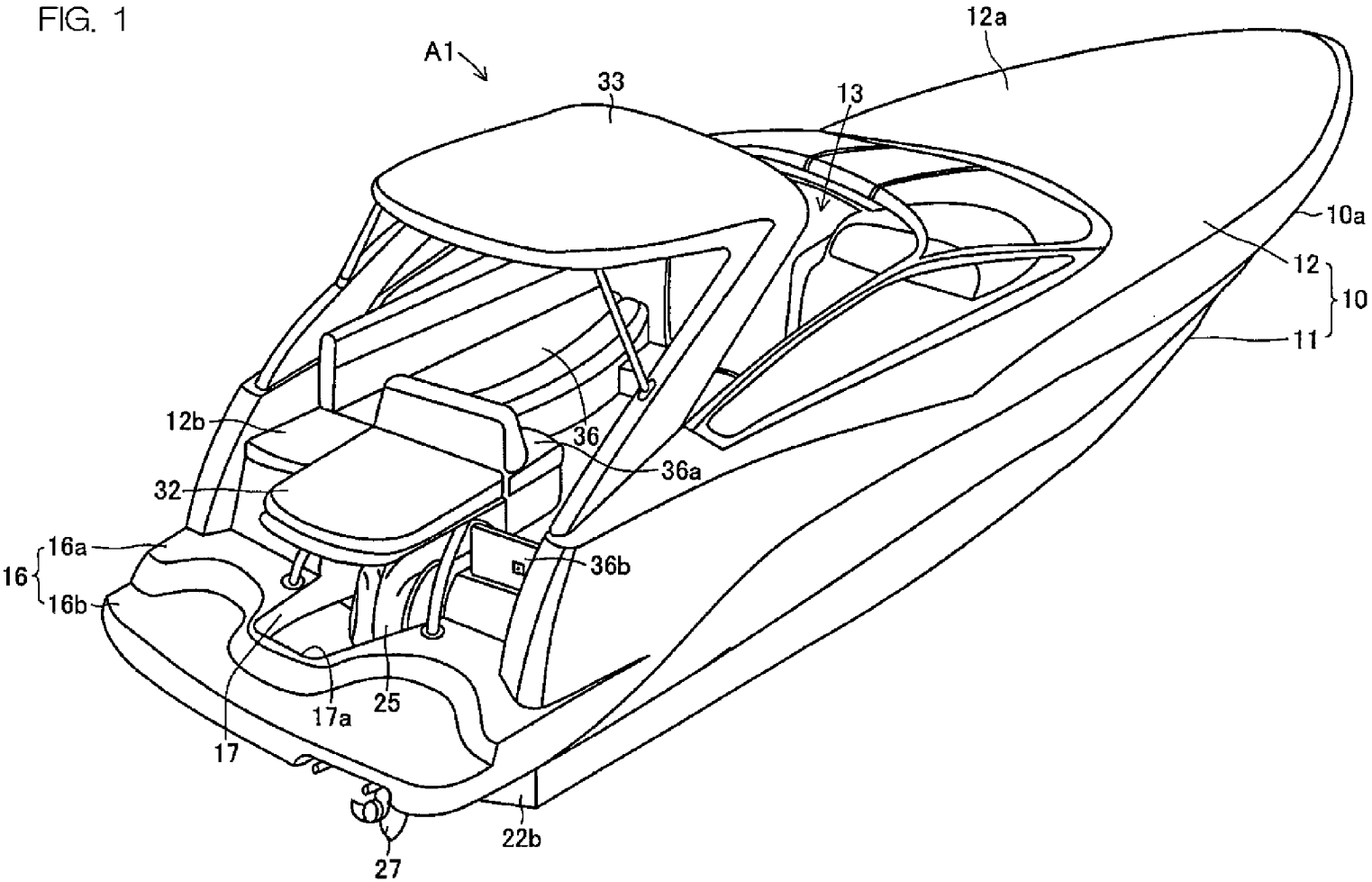
FIG. 1 is a perspective view showing a marine vessel according to a first preferred embodiment of the present invention.
Figure 2:
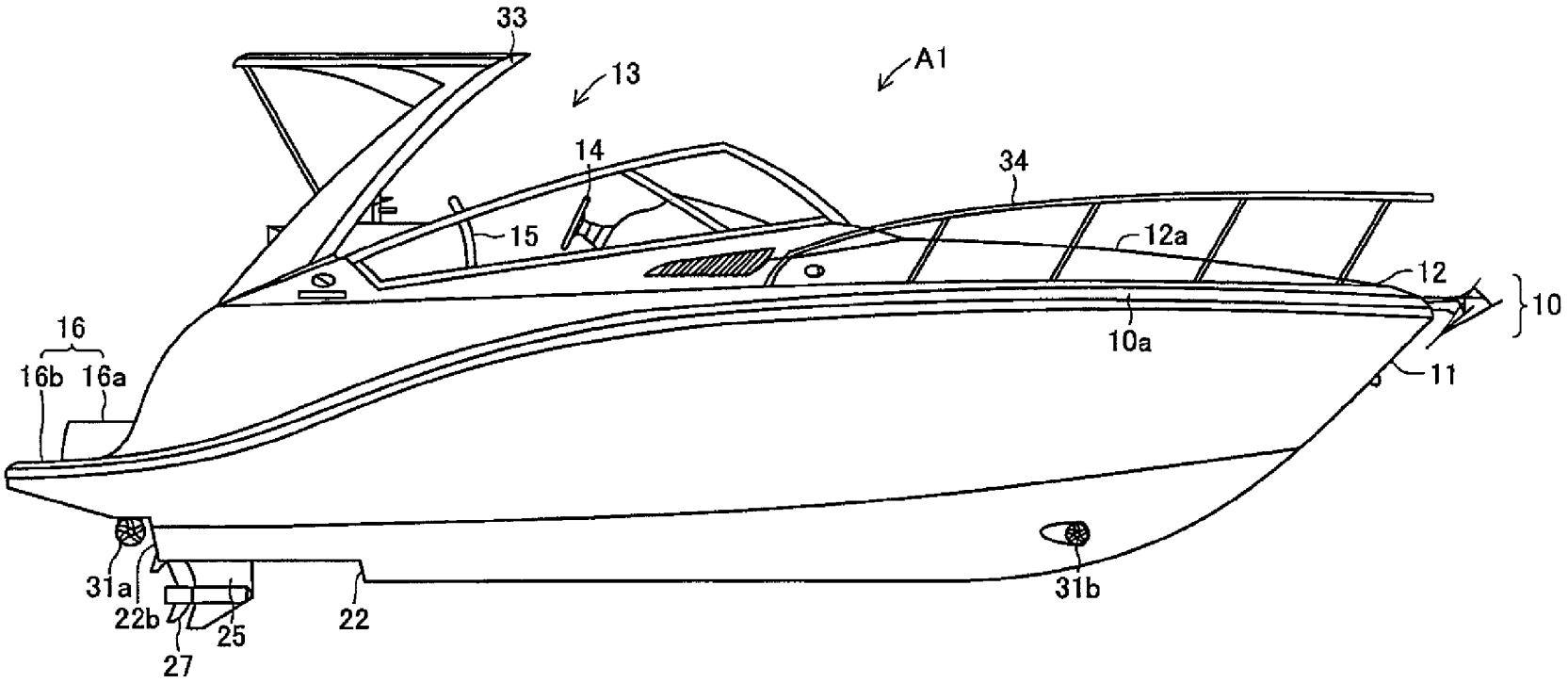
FIG. 2 is a side view showing the marine vessel according to the first preferred embodiment of the present invention.
Figure 3:
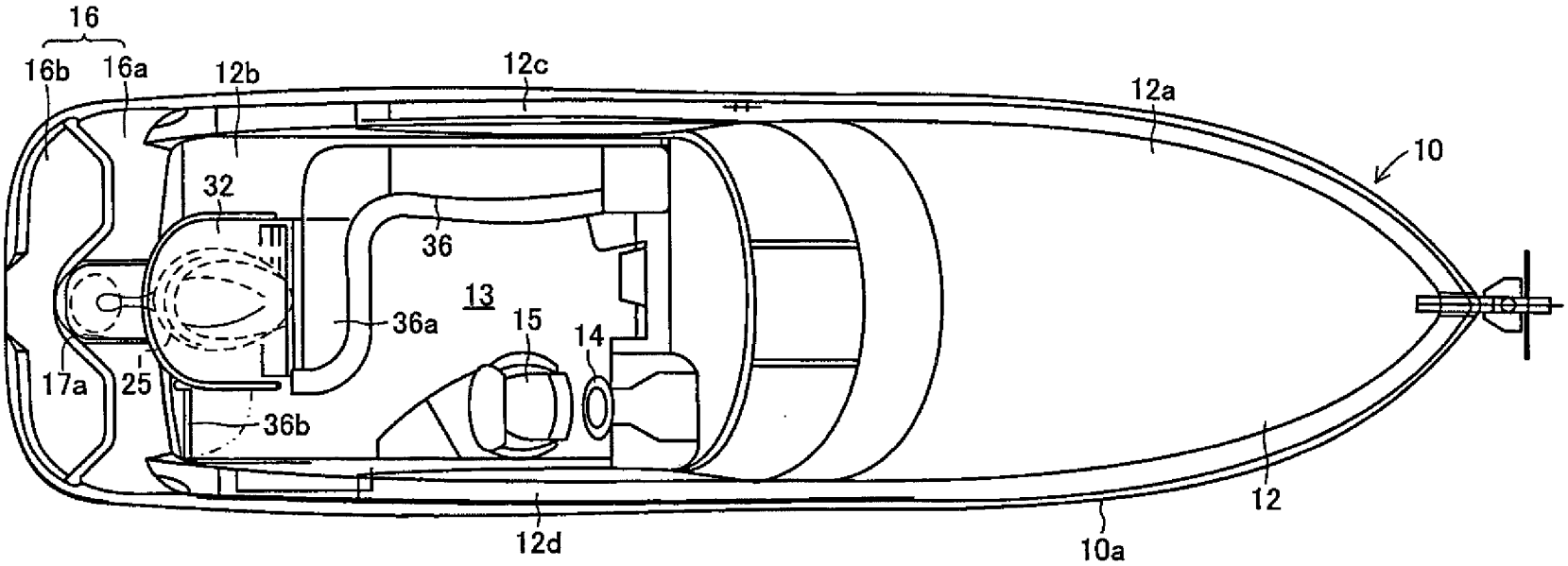
FIG. 3 is a plan view showing the marine vessel according to the first preferred embodiment of the present invention.

FIG. 1 to FIG. 3 show a cruiser type marine vessel A according to a first preferred embodiment of the present invention.

A hull 10 of the marine vessel A1 includes a body 11 including a hull bottom portion and a deck 12. The peripheral edge portions of the body 11 and the deck 12 are joined to each other in a watertight manner. On the periphery of the hull 10, a gunwale portion 10*a* is provided. Further, a cockpit 13 whose periphery is open is provided from the substantially center in the front-rear direction of an upper portion to a rear portion of the hull 10. On the starboard side inside the cockpit 13, a steering mechanism 14 and a driver's seat 15 are provided alongside in the front-rear direction. Near the steering mechanism 14, various devices necessary for steering the marine vessel A1, such as a start switch, gauges, and an accelerating and decelerating operation lever are provided.

At a front-side portion forward relative to the cockpit 13 on the upper surface of the deck 12, a bow-side deck 12*a* that is a wide plane portion is provided. As shown in FIG. 3, at a rear-side portion rearward relative to the cockpit 13 on the upper surface of the deck 12, a stern-side deck 12*b* that is a plane portion narrower than the bow-side deck 12*a* is provided. The bow-side deck 12*a* and the stern-side deck 12*b* are connected by aisles 12*c* and 12*d* narrow and long extending in the front-rear direction and provided on the left and right sides of the cockpit 13. As shown in FIG. 1, on a lower rear portion of the stern-side deck 12*b*, a platform 16 having a substantially U shape in a plan view is provided.

Further, an outboard motor locating hole 17 is provided to penetrate vertically through the central side in the width direction of the stern-side deck 12*b* on a rear-side portion of the hull 10 and the central side in the width direction of the front portion of the platform 16. The platform 16 is provided on both sides and the rear side of the rear-side portion (notched hole 17*a* described later) of the outboard motor locating hole 17. The platform 16 includes a front-side step 16*a* positioned on the front portion side and a rear-side step 16*b* positioned on the rear portion side.

A central portion in the right-left direction of the front edge portion of the rear-side step 16*b* is provided in a recess portion along the rear edge portion of the outboard motor locating hole 17. Both side portions of the recess portion are preferably configured to be convex so that their central portions in the right-left direction project toward the front-side step 16*a* side. Therefore, the boundary between the front-side step 16*a* and the rear-side step 16*b* is a wavy curve.

The upper portion of the platform 16 is configured in a stepped manner so as to become higher in a forward direction thereof. Specifically, between the front-side step 16*a* and the rear-side step 16*b*, a level difference that makes the front-side step 16*b* higher than the rear-side step 16*b* is provided. The height of the front-side step 16*a* is set to be, for example, substantially equal to the height of the pier when the marine vessel A1 comes alongside the pier. The height of the rear-side step 16*b* is set to be, for example, slightly higher than the water surface. Therefore, an occupant can easily get on/off the marine vessel A1 by using the front-side step 16*a*. Further, an occupant can easily move between the marine vessel A1 and the water by using the rear-side step 16*b*. Further, water that is about to enter the inside of the marine vessel A1 from the rear side is held back by the level difference between the front-side step 16*a* and the rear-side step 16*b*. Specifically, the level difference between the front-side step 16*a* and the rear-side step 16*b* functions as a weir for holding water back.

Figure 4:
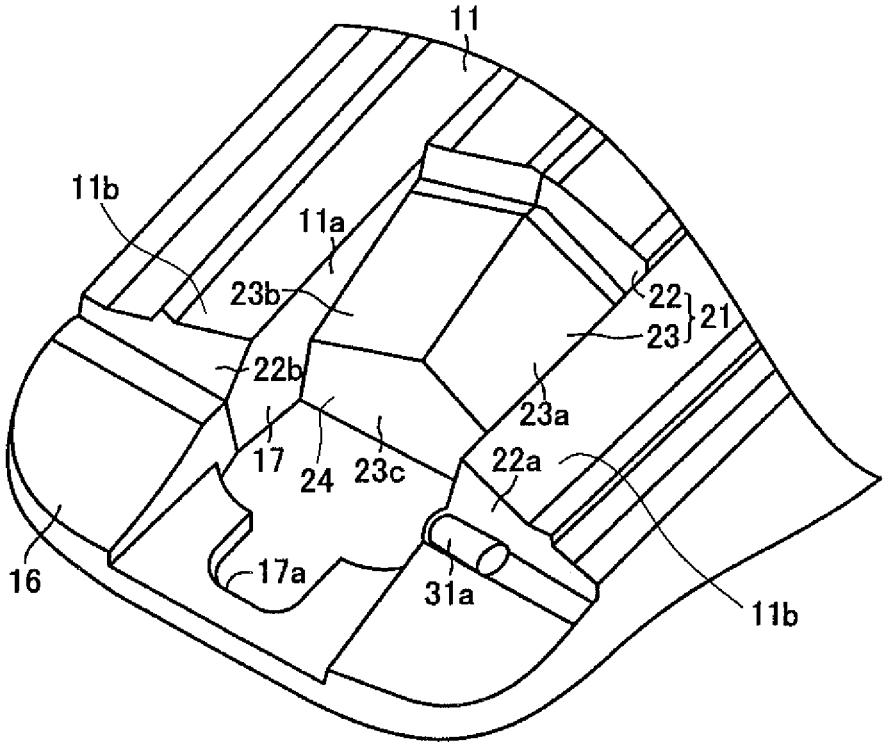
FIG. 4 is a perspective view of a vessel bottom rear portion according to the first preferred embodiment of the present invention from below.

As shown in FIG. 4, at the center in the width direction on the rear portion side of the bottom portion of the body 11, a recess portion 11*a* whose lower portion and rear portion are open is preferably provided. The rear portion of this recess portion 11*a* is connected to the outboard motor locating hole 17. A double ender bottom transom 21 is provided by the rear portion of the recess portion 11*a*. The bottom transom 21 includes a water drain surface 22 (first water drain surface) and an outboard motor mounting portion 23 projecting rearward from the water drain surface 22. The water drain surface 22 includes a nearly-vertical surface whose upper end portion is positioned slightly rearward relative to its lower end portion. The water drain surface 22 includes a vertical wall surface positioned on the front side of the recess portion 11*a*. The water drain surface 22 includes a surface having a substantially V shape that is bilaterally symmetrical and extends with a substantially constant width along the lower edge portion of the substantially V shape of the body 11.

The lower edge portion (the upper edge portion in FIG. 4) of the outboard motor mounting portion 23 preferably has a substantially V shape along the upper edge portion (the lower edge portion in FIG. 4) of the water drain surface 22 in a back view. Further, the upper edge portion (the lower edge portion in FIG. 4) of the outboard motor mounting portion 23 preferably has a linear configuration so as to extend horizontally in the right-left direction in a back view. The outboard motor mounting portion 23 preferably has a substantially pentagonal shape bilaterally symmetrical and having a predetermined length vertically in a back view.

The lower edge portion of the outboard motor mounting portion 23 includes, in a side view, an inclined portion extending upward from the upper end of the central portion in the right-left direction of the water drain surface 22 to the rear side and a portion extending at an angle close to 90 degrees rearward from the lower end of the inclined portion. Specifically, the surface of the outboard motor mounting portion 23 includes a pair of inclined surface portions 23*a* and 23*b* of a quadrangle and a rear surface portion 23*c* of a pentagon. Each inclined surface portion 23*a*, 23*b* preferably includes a convex surface that is bilaterally symmetrical, and is arranged to become gradually higher toward the outer side (outer side in the right-left direction) and the rear portion side. The rear surface portion 23*c* preferably includes a nearly-vertical inclined surface. The rear surface portion 23*c* functions as a water drain surface.

Figure 5:
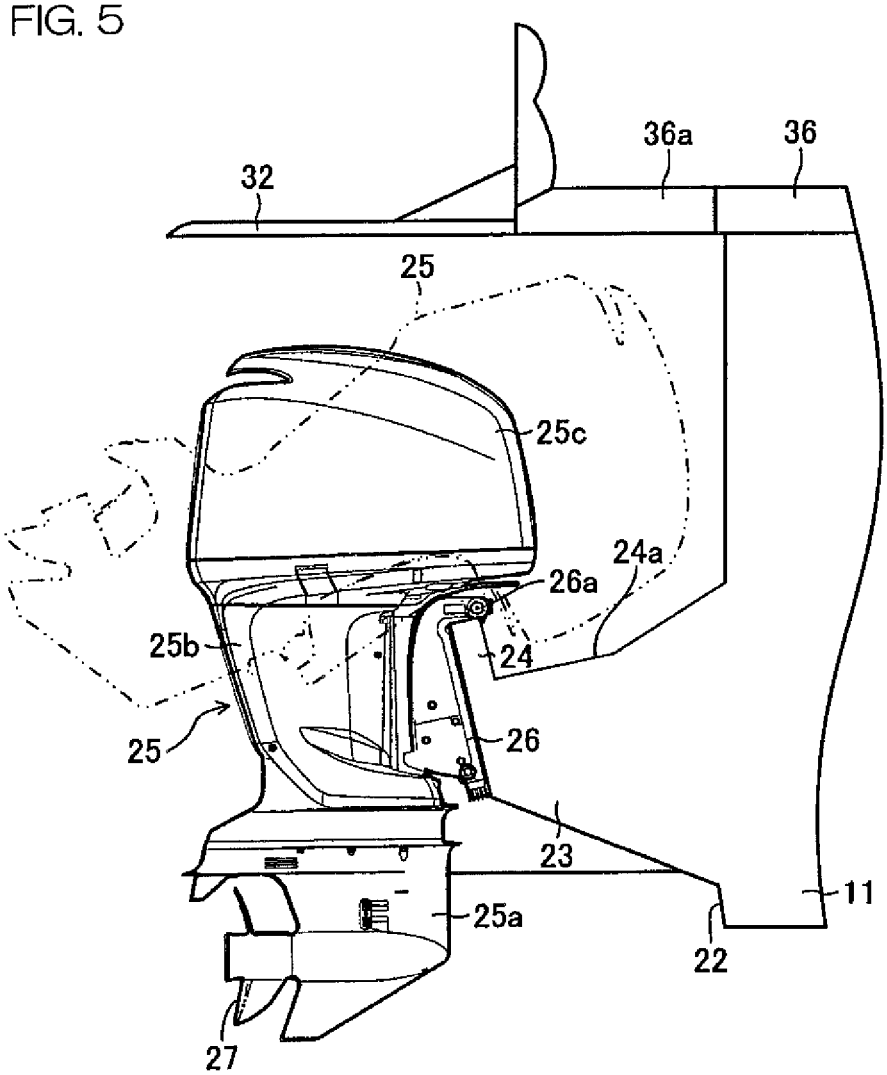
FIG. 5 is a side view showing a state in which an outboard motor according to the first preferred embodiment of the present invention rotates up and down.

As shown in FIG. 4, the rear surface portion 23*c* of the outboard motor mounting portion 23 is a front-side portion of the peripheral surface including the outboard motor locating hole 17. As shown in FIG. 5, on a rear portion of the outboard motor mounting portion 23, a mounting portion 24 is provided. The outboard motor 25 is mounted to the mounting portion 24. A contact avoiding recess portion 24*a* that the upper portion of the outboard motor 25 enters when the outboard motor 25 is tilted up is provided on the front side of the mounting portion 24 on the upper portion of the outboard motor mounting portion 23.

As shown in FIG. 4, the body 11 includes a pair of extending portions 11*b* positioned on the left and right sides of the recess portion 11*a*. Each extended portion 11*b* extends in the front-rear direction at a height substantially equal to the height of the front-side portion thereof. Each extended portion 11*b* extends rearward to a portion corresponding to the substantially center in the front-rear direction of the outboard motor locating hole 17. One extended portion 11*b* includes a water drain surface 22*a* (second water drain surface) provided on its rear end portion. The other extended portion 11*b* includes a water drain surface 22*b* (second water drain surface) provided on its rear end portion. Each water drain surface 22*a*, 22*b* preferably includes an inclined surface whose upper end is positioned rearward relative to its lower end portion. The inclination angles of the water drain surfaces 22*a* and 22*b* are set so that they preferably become parallel or substantially to the water drain surface 22 and the rear surface portion 23*c*. The water drain surfaces 22*a* and 22*b* are disposed rearward relative to the rear surface portion 23*c*.

Further, as shown in FIG. 4, rear-side portions of the water drain surfaces 22*a* and 22*b* on the bottom surface of the body 11 preferably include inclined surfaces that become gradually higher rearward. The portion between these two inclined surfaces (the rear-side portion of the outboard motor locating hole 17) includes a horizontal surface. Specifically, the central portion in the right-left direction of the rear-side step 16*b* of the platform 16 preferably has a tabular shape having an even thickness and disposed horizontally. The upper surfaces on both side portions in the right-left direction of the rear-side step 16*b* preferably include horizontal surfaces connected to the central portion. The lower surfaces of both side portions in the right-left direction of the rear-side step 16*b* preferably include inclined surfaces whose front portions are lower than their rear portions. Accordingly, both side portions in the right-left direction of the rear-side step 16*b* gradually increase in thickness toward the front portion side. The lower surface of the central portion of the rear-side step 16*b* is disposed higher than the lower surface rear end portions of both side portions of the rear-side step. Therefore, a level difference is provided between the central portion and both side portions of the lower surface of the rear-side step 16*b* so that the central portion becomes higher than both side portions.

As shown in FIG. 4, on the rear side of the outboard motor locating hole 17 on the platform 16, a notched hole 17*a* is provided. The lengths in the right-left direction and the front-rear direction of the notched hole 17*a* are, for example, about half the lengths in the right-left direction and the front-rear direction of the outboard motor locating hole 17.

The outboard motor 25 is surrounded by wall portions around the outboard motor locating hole 17. Accordingly, not only the front portion and both side portions but also the rear portion of the outboard motor 25 are protected. As shown in FIG. 5, the outboard motor 25 is mounted to the mounting portion 24 via a mounting member 26 including a swivel bracket or a clamp bracket. The mounting member 26 includes a tilt/trim shaft 26*a* extending horizontally and a steering shaft (not shown) extending vertically. The outboard motor 25 is arranged to be turnable up and down around the tilt/trim shaft 26*a* according to actuation of a tilt/trim device (not shown). The outboard motor 25 is arranged to be turnable to the left and right around the steering shaft (not shown).

As shown in FIG. 5, the outboard motor 25 includes a lower case 25*a*, an upper case 25*b* joined to an upper portion of the lower case 25*a*, and a cowling (engine cover) 25*c* joined to an upper portion of the upper case 25*b*. The outboard motor 25 includes a thruster, a drive shaft, an engine, and a crankshaft although these are not shown. The thruster is provided in the lower case 25*a*. The thruster includes a thrust shaft (not shown) disposed substantially horizontally, and a propeller 27 attached to the rear end of the thrust shaft. The drive shaft is provided in the upper case 25*b*. The drive shaft is joined to the crankshaft. The engine and the crankshaft are provided in the cowling 25*c*. When the engine is driven, the driving force is transmitted to the propeller 27 via the crankshaft, the drive shaft, and the thrust shaft, etc. Accordingly, the propeller 27 rotates to generate a thrust.

Figure 6:
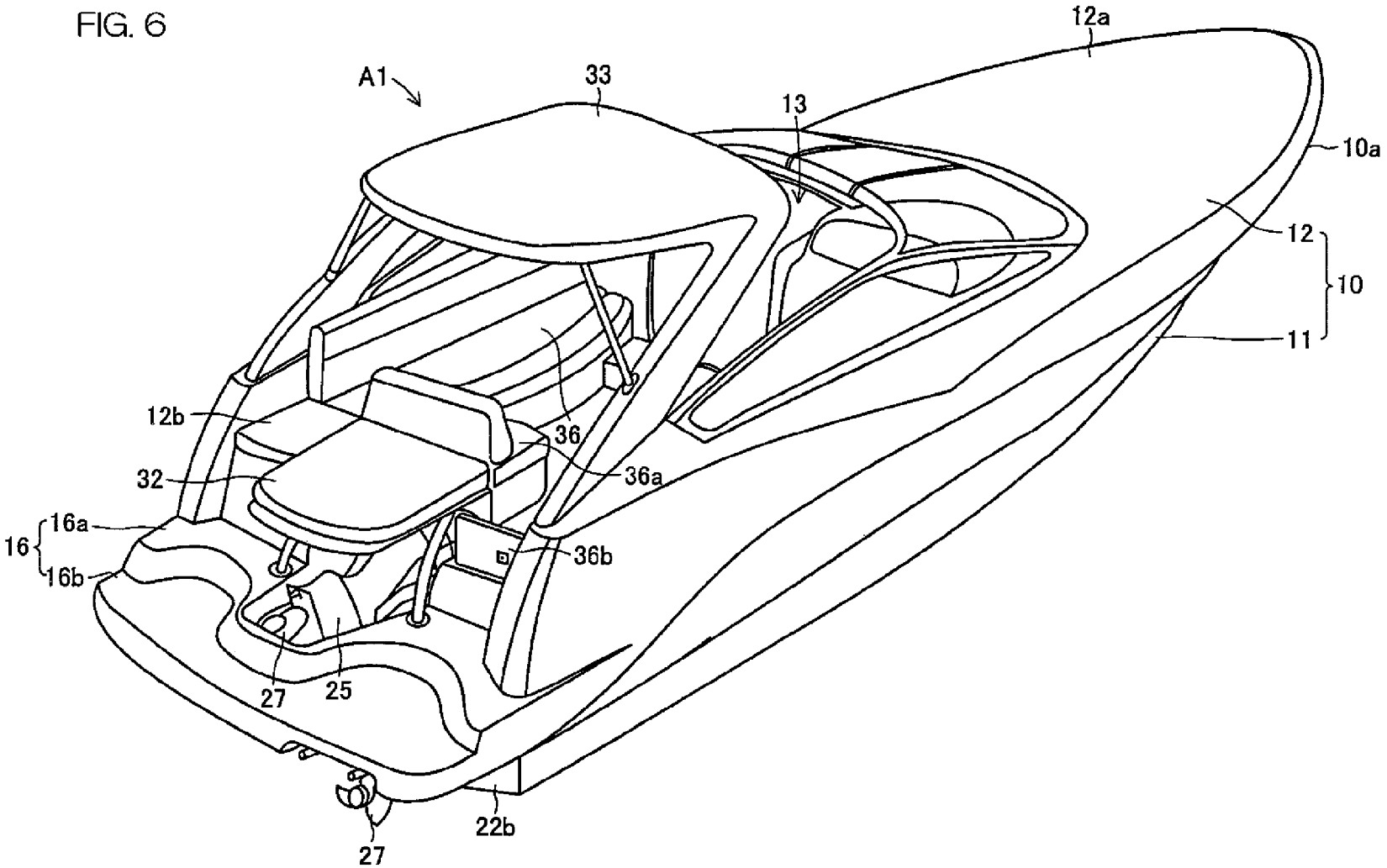
FIG. 6 is a perspective view showing the marine vessel in a state in which the outboard motor according to the first preferred embodiment of the present invention is tilted up.

As described above, the outboard motor 25 is arranged to be turnable up and down around the tilt/trim shaft 26*a*. The outboard motor 25 is changed in turning angle (tilt angle) in a range of a trim region according to a running state of the marine vessel A1. An inspection of the outboard motor 25 (for example, an inspection of the propeller 27) is conducted in a state in which the outboard motor 25 is tilted up while the marine vessel A1 is stopped. The outboard motor 25 shown by the alternate long and two short dashed lines in FIG. 5 and the outboard motor 25 shown in FIG. 6 are in a tilted-up state.

The lower portion (lower case 25*a* and the propeller 27) of the outboard motor 25 passes through the inside of the notched hole 17*a* when the outboard motor 25 is tilted up. Specifically, the notched hole 17*a* is provided to allow the lower portion of the outboard motor 25 to pass through. The front portion of the cowling 25*c* (in FIG. 5, the lower portion of the cowling 25*c* shown by the alternate long and two short dashed lines) enters the inside of the contact avoiding recess portion 24*a* when tilt-up of the outboard motor 25 is finished (that is, the tilt angle of the outboard motor 25 becomes not less than a predetermined value). Accordingly, the space in which an occupant can move on the platform 16 is increased. Further, the space of the upper portion of the outboard motor mounting portion 23 is effectively used.

As shown in FIG. 4, near the water drain surface 22*a* on the portside bottom surface of the rear-side step 16*b*, a rear side thruster 31*a* is provided. As shown in FIG. 2, on a bow-side lower portion of the body 11, a front side thruster 31*b* penetrating through the body 11 in the right-left direction is provided. Each of the rear side thruster 31*a* and the front side thruster 31*b* includes a tubular main body extending in the right-left direction and a propeller provided at the center of the inside of the tubular main body. Each propeller is rotated by a drive motor (not shown) installed inside the body 11. By the rotation of each propeller, a water flow flowing from one side to the other side of the inside of the tubular main body is generated. The rotation direction of each propeller is changed by the drive motor. By rotating the propeller provided in the rear side thruster 31*a*, the stern of the marine vessel A1 is moved to the left or right. By rotating the propeller provided in the front side thruster 31*b*, the bow of the marine vessel A1 is moved to the left or right.

Figure 7:
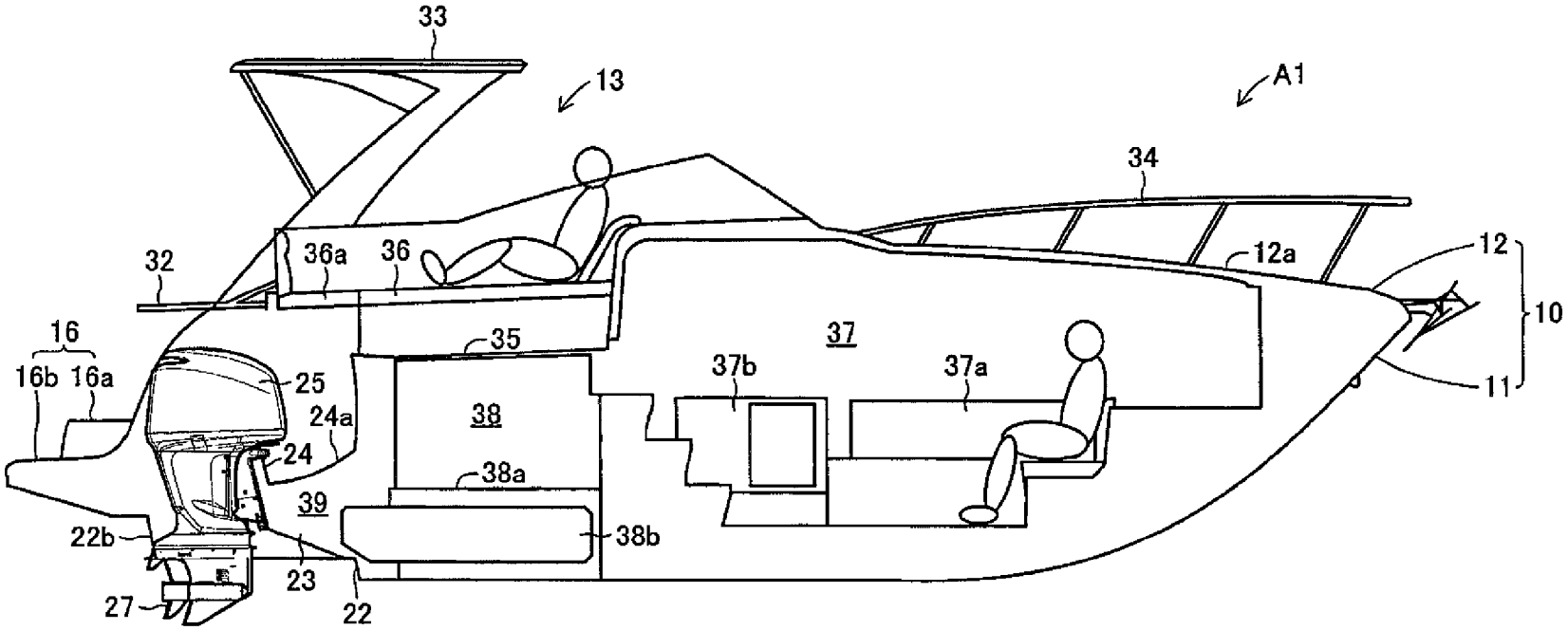
FIG. 7 is a sectional view schematically showing the inside of the marine vessel according to the first preferred embodiment of the present invention.
Figure 8:
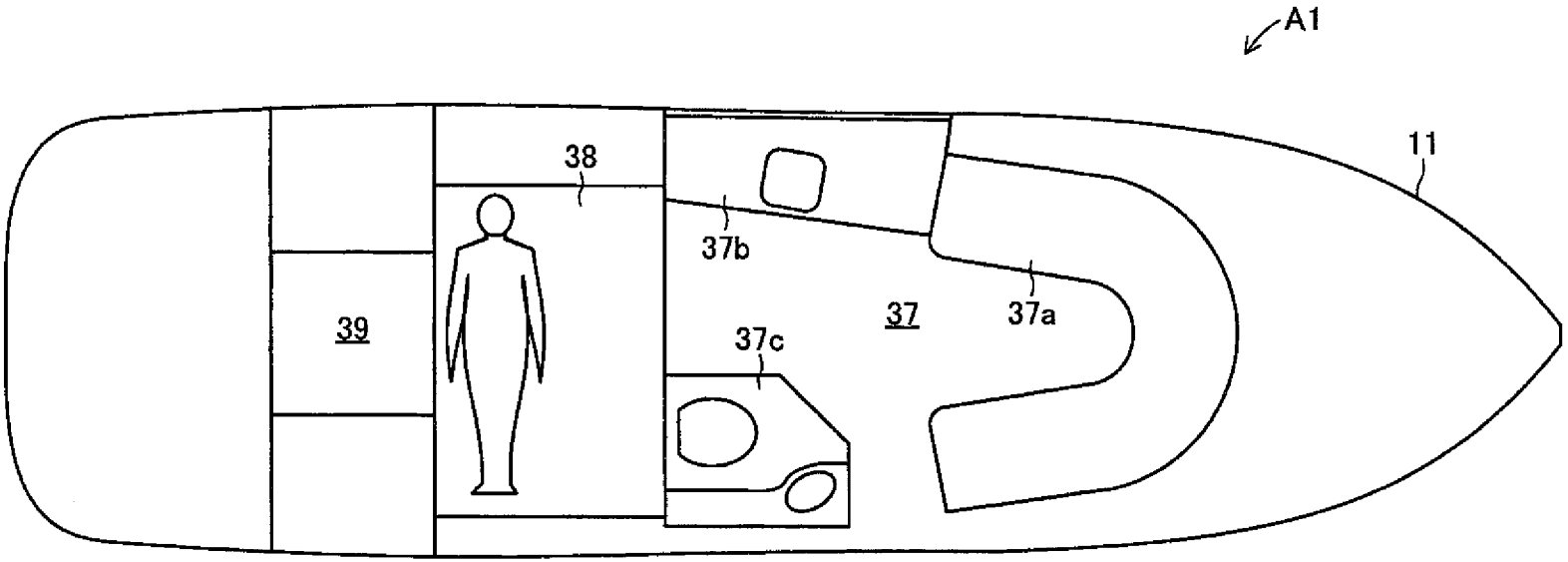
FIG. 8 is a plan view schematically showing the inside of the marine vessel according to the first preferred embodiment of the present invention.

As shown in FIG. 1, the marine vessel A1 includes a table 32 (ceiling portion) disposed on the upper portion of the outboard motor 25 (not tilted up) on the stern-side deck 12*b*, and a gate-shaped float wing 33 disposed on the rear portion of the deck 12. The table 32 is used as a base for placing objects thereon. Further, the table 32 prevents objects and persons from falling into the outboard motor locating hole 17. The float wing 33 extends up obliquely forward from the rear portion of the deck 12. As shown in FIG. 2 and FIG. 7, the marine vessel A1 includes a handrail 34 (not shown in drawings except for FIG. 2 and FIG. 7) disposed in the range from the central side to the front portion of the outer peripheral portion of the deck 12. As shown in FIG. 7 and FIG. 8, the marine vessel A1 preferably includes an installation space provided inside the hull 10. Various rooms, a generator, a fuel tank, and a clear water tank, and a battery, etc., may preferably be provided in this installation space.

As shown in FIG. 7, the inside of the hull 10 is partitioned up and down by the deck floor surface 35. On the upper portion of the deck floor surface 35, the above-described cockpit 13 is disposed. From the portside to the rear portion inside the cockpit 13, a sofa 36 having, for example, an L shape in a plan view is preferably installed. The above-described table 32 is installed on the back surface of the rear-side portion of the sofa 36. The rear-side portion of the sofa 36 includes a removable portion 36*a* that also functions as a removable lid member. The contact avoiding recess portion 24*a* is positioned downward of the removable portion 36*a*. An occupant can easily access the outboard motor 25 from the cockpit 13 by removing the removable portion 36*a*.

The sofa 36 also has an effect of shielding against driving noise of the outboard motor 25 and preventing the driving noise from being transmitted to the cockpit 13. As shown in FIG. 1, on the starboard rear side of the sofa 36, an opening and closing door 36*b* that serves as a partition between the stern-side deck 12*b* and the platform 16 is provided. Between the stern-side deck 12*b* and the platform 16, a level difference is provided so that the stern-side deck 12*b* becomes higher than the platform 16, and the opening and closing door 36*b* is installed along the rear edge portion of the stern-side deck 12*b*.

As shown in FIG. 7, on the lower portion side of the deck floor surface 35 inside the hull 10, a main salon 37 disposed on the front portion side of the marine vessel A1, a break room 38 disposed on the rear portion side, a space 39 disposed at the rear of the break room 38, and so on are provided. The break room 38 is a space to be used by an occupant to take a break. The above-described generator, etc., and various pipes and devices are installed in the space 39. In the main salon 37, a sofa 37*a* having a U shape in a plan view, a sink cabinet 37*b*, and a lavatory 37*c*, etc., are installed. In the break room 38, a bed 38*a* is installed. At the lower portion of the bed 38*a*, a fuel tank 38*b* is installed.

Thus, in the marine vessel A1, the space inside the hull 10 is effectively used. Further, the marine vessel A1 is propelled by the outboard motor 25, so that it is not necessary to secure a space for disposing predetermined equipment such as an engine inside the hull 10. Therefore, the space that an occupant can use inside the hull 10 is increased.

A plurality of occupants (crew members or passengers) including a driver and fellow passengers can get on the marine vessel A1 from the starboard side of the front-side step 16*a* and enter the cockpit 13 by opening the opening and closing door 36*b* and passing through the stern-side deck 12*b* in a state in which the starboard side of the marine vessel A1 is caused to come alongside the pier and the marine vessel A1 is stopped. Then, a driver can sit on the driver's seat and operate the steering mechanism 14. Occupants other than the driver can sit on the sofa 36 inside the cockpit 13, sit on the sofa 37*a* in the main salon 37, and lie down on the bed 38*a*. The marine vessel A1 with a plurality of occupants is made to run by operations of the operation lever and the steering mechanism 14 in a state in which the start switch installed near the steering mechanism 14 is turned on by the driver sitting on the driver's seat 15.

As the running speed of the marine vessel A1 is increased, the marine vessel A1 inclines so that the bow side becomes higher than the stern side. On the other hand, the left and right side portions (a pair of extending portions 11*b*) of the recess portion 11*a* on the bottom surface rear portion side of the body 11 are extended rearward. Further, on the rear end portions of the pair of extending portions 11*b*, the water drain surfaces 22*a* and 22*b* are provided. Therefore, the distance between the center of gravity of the hull 10 and the water drain surfaces (water drain surfaces 22*a* and 22*b*) is increased as viewed in the front-rear direction. Accordingly, the marine vessel A1 can run at a high speed. When the running speed of the marine vessel A1 becomes not less than a predetermined speed, water at the water surface is drained by the water drain surfaces 22, 22*a*, and 22*b*, and the outboard motor mounting portion 23 is positioned higher than the water surface.

Accordingly, the outboard motor mounting portion 23 is prevented from generating any resistance and harmfully influencing running of the marine vessel A1.

During running of the marine vessel A1, the lower portion of the outboard motor 25 enters a water flow that moves up obliquely rearward from the lower edge portion of the water drain surface 22. Therefore, the propeller 27 of the outboard motor 25 can reliably catch the water flow. Accordingly, a marine vessel A having a high restoring force is realized. In particular, when the marine vessel A turns at a high speed, the marine vessel A can turn without the occurrence of drawing air.

When the marine vessel A stops on water, the outboard motor mounting portion 23 sinks in water and generates buoyancy. Therefore, even when an occupant moves to the stern side, the stern side of the marine vessel A is prevented from sinking downward and the marine vessel A1 is prevented from greatly inclining. In this state, an occupant can fish on the bow-side deck 12*a* or the platform 16, and sunbathe on the bow-side deck 12*a*. When an occupant swims, the occupant can get into the water from the rear-side step 16*b*. Further, an occupant can freely move on the platform 16 as appropriate.

Further, for example, when the outboard motor 25 requires an inspection, etc., and the outboard motor 25 is tilted up on water, the outboard motor 25 rotates around the tilt/trim shaft 26*a* inside the outboard motor locating hole 17 so as to move the lower portion upward. At this time, the lower portion of the outboard motor 25 passes through the inside of the notched hole 17*a* and moves upward. Then, as shown in FIG. 5, the front portion of the cowling 25*c* enters the inside of the contact avoiding recess portion 24*a*. Therefore, the outboard motor 25 can smoothly rotate without contact with objects around. When the marine vessel A1 is caused to come alongside the pier, it can be caused to smoothly come alongside the pier by actuating the rear side thruster 31*a* and the front side thruster 31*b*.

As described above, in the present preferred embodiment, the outboard motor locating hole 17 is provided at the stern of the hull 10. The outboard motor 25 is mounted to the mounting portion 24 of the front wall portion of the outboard motor locating hole 17. Therefore, an occupant can freely move on the portion around the outboard motor 25 on the platform 16.

The mounting portion 24 to which the outboard motor 25 is mounted is provided on the upper portion of the front wall portion of the outboard motor locating hole 17. The front wall portion of the outboard motor locating hole 17 defines the rear wall surface of the outboard motor mounting portion 23 provided on the rear portion of the water drain surface 22. Accordingly, the distance between the water drain surface 22 and the outboard motor 25 is increased. Therefore, air drawing can be prevented from occurring at the propeller 27 of the outboard motor 25, and the acceleration performance of the marine vessel A1 is improved.

Further, the outboard motor 25 is surrounded by the platform 16, so that when the stern of the marine vessel A1 is brought into contact with the pier, etc., or an object collides from the rear side, the outboard motor 25 is prevented from being broken or damaged. Further, the portions (a pair of extending portions 11*b*) positioned on both sides of the outboard motor mounting portion 23 on the bottom portion of the body 11 are extended to the stern side, and at the rear end portions of these portions, the water drain surfaces 22*a* and 22*b* are provided. Therefore, the distance between the center of gravity of the hull 10 and the water drain surfaces 22*a* and 22*b* as viewed in the front-rear direction is increased. Accordingly, the acceleration performance of the marine vessel A1 is further improved. The water drain surfaces 22*a* and 22*b* are provided rearward of the water drain surface 22 that is equivalent to the transom of a conventional marine vessel, so that acceleration performance equivalent to that in the case where the distance between the center of gravity of the hull 10 and the water drain surfaces is increased is obtained.

The notched hole 17*a* is provided at the rear portion of the outboard motor locating hole 17. Further, the contact avoiding recess portion 24*a* is provided on the upper portion of the outboard motor mounting portion 23. Therefore, the outboard motor 25 can be smoothly tilted up. By providing the notched hole 17*a*, the entire size of the outboard motor locating hole 17 is made smaller, so that the space in which an occupant can move on the platform 16 is increased. The table 32 covering the outboard motor 25 is provided above the outboard motor locating hole 17, so that objects and occupants can be prevented from falling into the inside of the outboard motor locating hole 17.

The platform 16 includes the front-side step 16*a* and the rear-side step 16*b* whose height is lower than the height of the front-side step 16*a*. Therefore, the front-side step 16*a* is used, for example, by an occupant to move between the pier and the marine vessel A1. The rear-side step 16*b* is used by an occupant to move between the marine vessel A1 and the water. Therefore, an occupant can easily move between the marine vessel A1 and the pier and between the marine vessel A1 and the water. Further, the level difference between the front-side step 16*a* and the rear-side step 16*b* functions as a weir to hold back water entering onto the rear-side step 16*b*. Therefore, entering of water onto the front-side step 16*a* can be prevented.

Second Preferred Embodiment

Hereinafter, a marine vessel A2 according to a second preferred embodiment of the present invention will be described in detail with reference to FIG. 9 to FIG. 20. A major difference between this second preferred embodiment and the above-described first preferred embodiment is that the hatch 203 arranged to be capable of closing the notched hole 213 is attached to the platform 202. In FIG. 9 to FIG. 20, components equivalent to the components shown in FIG. 1 to FIG. 8 described above are denoted by the same reference numerals as in FIG. 1, etc., and description thereof will be omitted.

Figure 9:
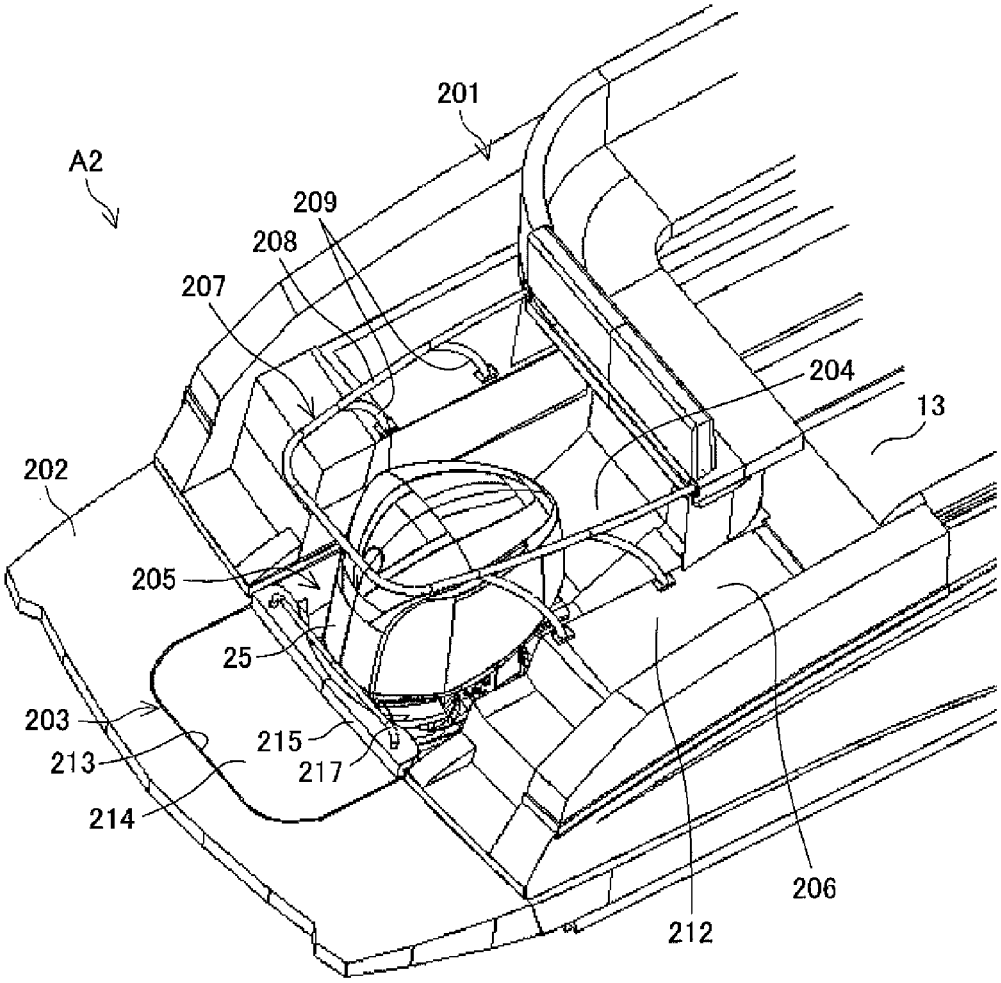
FIG. 9 is a perspective view of the stern of a marine vessel according to a second preferred embodiment of the present invention.
Figure 10:
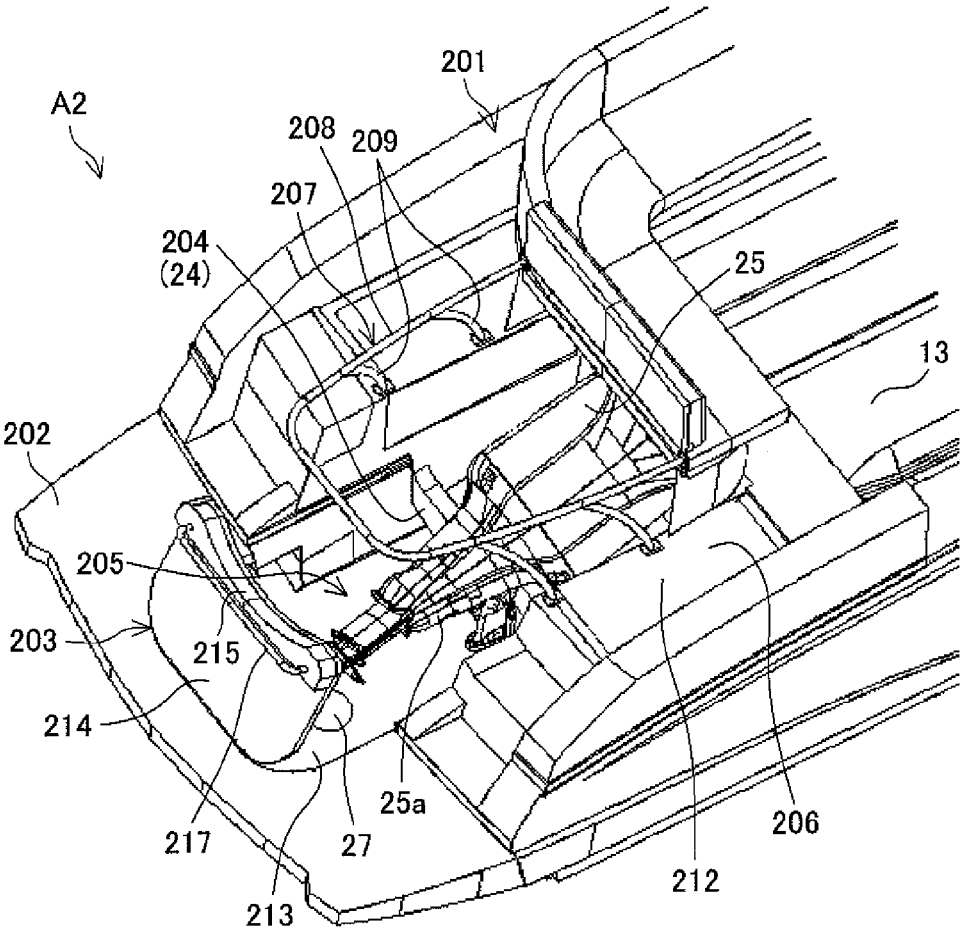
FIG. 10 is a perspective view of the stern of the marine vessel according to the second preferred embodiment of the present invention.
Figure 11:
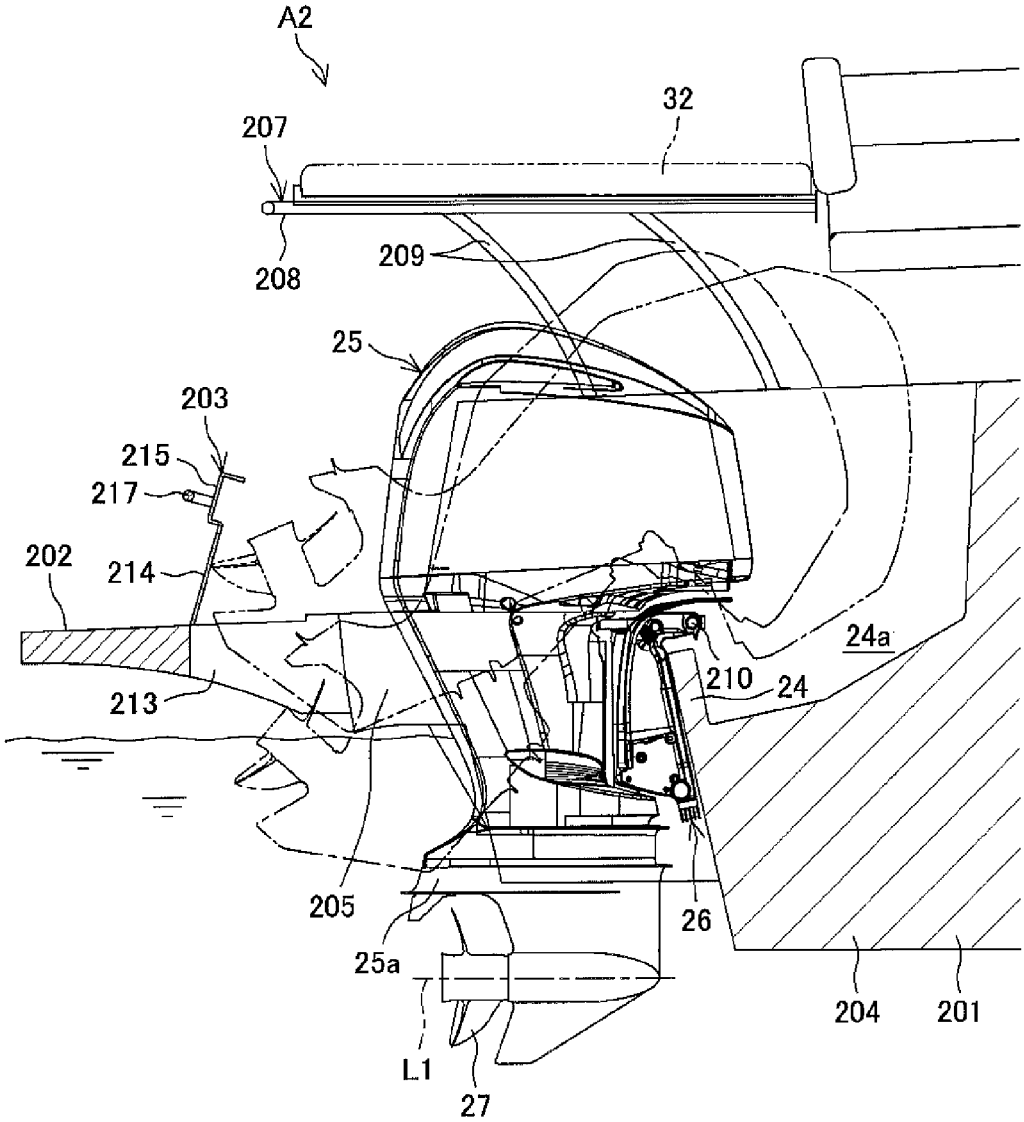
FIG. 11 is a partial sectional view of the stern of the marine vessel taken along line XI-XI in FIG. 12.
Figure 12:
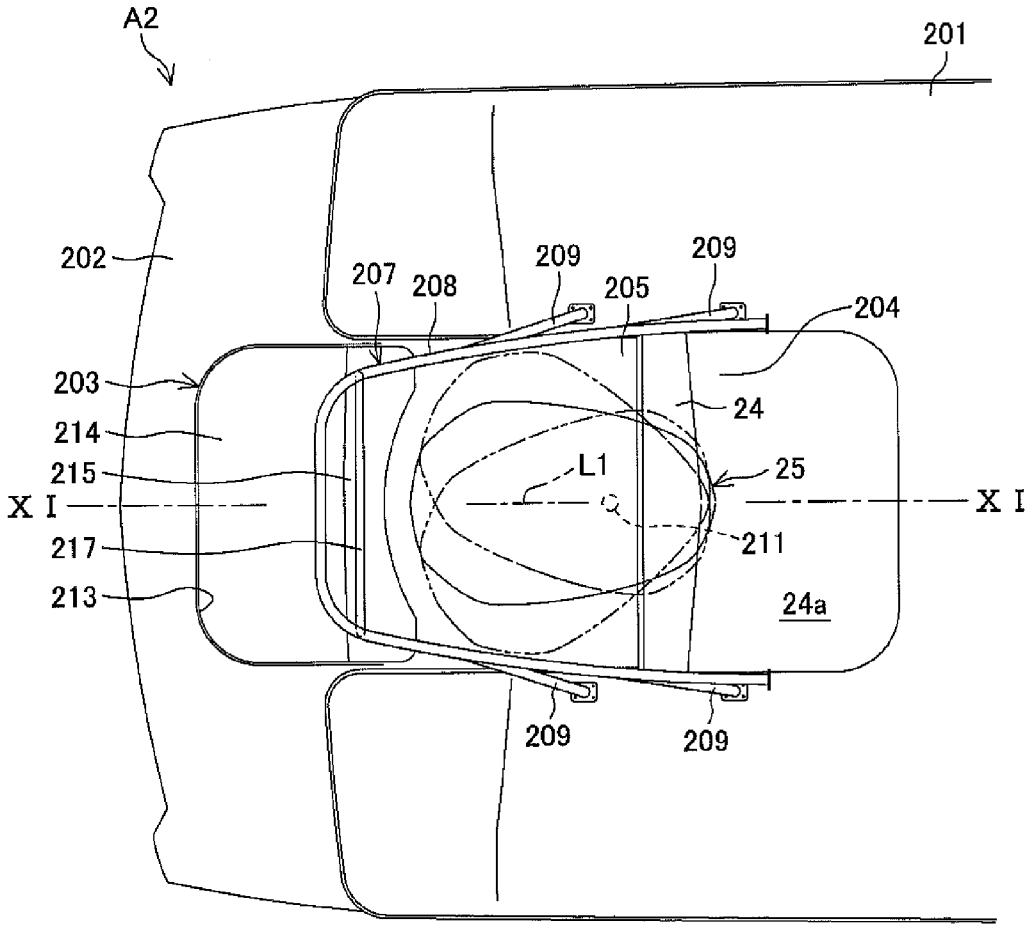
FIG. 12 is a plan view of the stern of the marine vessel according to the second preferred embodiment of the present invention.

FIG. 9 and FIG. 10 are perspective views of the stern of the marine vessel A2 according to the second preferred embodiment of the present invention. FIG. 11 is a partial sectional view of the stern of the marine vessel A2 taken along line XI-XI in FIG. 12, and FIG. 12 is a plan view of the stern of the marine vessel A2. FIG. 9 shows a state in which the hatch 203 is closed. FIG. 10 shows a state in which the hatch 203 is opened and the outboard motor 25 steered rightward is tilted around the tilt/trim shaft 210. In FIG. 11 and FIG. 12, an illustration of a portion of the arrangement of the marine vessel A2 is omitted.

The marine vessel A2 includes a hull 201, an outboard motor 25 mounted to the stern of the hull 201, a platform 202 attached to the stern of the hull 201 on the side rearward of the outboard motor 25, and a hatch 203 attached in a vertically openable and closable manner to the platform 202. The hull 201 includes an outboard motor mounting portion 204 and an outboard motor locating hole 205 provided at the stern of the hull 201. The outboard motor mounting portion 204 is provided at the central portion in the right-left direction of the stern of the hull 201. The outboard motor mounting portion 204 is provided on the bottom portion of the stern of the hull 201. The outboard motor mounting portion 204 includes a mounting portion 24 provided on the rear portion of the outboard motor mounting portion 204, and a contact avoiding recess portion 24*a* provided on the upper portion of the outboard motor mounting portion 204. The contact avoiding recess portion 24*a* is disposed on the front side of the mounting portion 24.

The outboard motor locating hole 205 is disposed at the rear of the outboard motor mounting portion 204 so as to be near the outboard motor mounting portion 204. The outboard motor locating hole 205 penetrates vertically through the stern of the hull 201. The outboard motor locating hole 205 is provided at the central portion in the right-left direction of the stern of the hull 201. The outboard motor locating hole 205 is preferably a notch-shaped portion extending forward from the rear end of the hull 201. The outboard motor locating hole 205 has a width (length in the right-left direction) substantially equal to that of the outboard motor mounting portion 204. The marine vessel A2 includes a guardrail 207 attached to the rear portion of the deck 206. Occupants are prevented from falling into the outboard motor locating hole 205 by the guardrail 207. The guardrail 207 preferably includes, for example, a plurality of pipes. The guardrail 207 preferably includes an upper portion 208 having a U shape in a plan view and a plurality of leg portions 209 supporting the upper portion 208. As shown by the alternate long and two short dashed lines in FIG. 11, a table 32 covering the outboard motor 25 may be attached to the upper portion 208.

The outboard motor 25 is inserted vertically through the outboard motor locating hole 205. The outboard motor 25 is mounted to the mounting portion 24 via a mounting member 26 in the state in which the outboard motor is inserted through the outboard motor locating hole 205. The outboard motor 25 is housed inside the outboard motor locating hole 205 when the marine vessel A2 is viewed from above. When the marine vessel is viewed from above, the outboard motor 25 is surrounded by the hull 201 and the platform 202. Therefore, the outboard motor 25 is protected by the hull 201 and the platform 202.

As shown in FIG. 11, the outboard motor 25 is arranged to be tiltable with respect to the hull 201 by turning up and down around the tilt/trim shaft 210 (horizontal axis). The tilt/trim shaft 210 is a horizontal shaft passing through the upper end portion of the mounting member 26 and the front portion of the outboard motor 25. The outboard motor 25 is arranged to be tiltable between a tilting origin (the position of the outboard motor 25 shown by the solid lines in FIG. 1) and a maximum tilt position (the position of the outboard motor 25 shown by the alternate long and two short dashed lines in FIG. 11). The tilting origin is a position at which the rotation axis L1 of the propeller 27 becomes substantially horizontal. The maximum tilt position is a position at which the position of the propeller 27 is above the platform 202.

The outboard motor 25 is controlled to tilt in the range of a trim region (running region) during high-speed running of the marine vessel A2. The outboard motor 25 is controlled to tilt in the range of a tilt region in a state in which the rotation of the propeller 27 is stopped when the propeller 27 is inspected or the marine vessel A2 is moored. Further, the outboard motor 25 is controlled to be positioned at a beaching position provided between the tilting origin and the maximum tilt position when the marine vessel A2 runs in shallow water or is beached. The trim region is a region in which the tilt angle of the outboard motor 25 is relatively small, and the tilt region is a region in which the tilt angle of the outboard motor 25 is relatively large. The trim region and the tilt region are regions different from each other. The beaching position is a position at which the lower end of the tilted outboard motor 25 is higher than the lower end (keel) of the hull 201 and at least a portion of the propeller 27 is in water. The beaching position may be a portion of the trim region or the tilt region.

The outboard motor 25 is arranged to be stoppable at a stop position (the position of the outboard motor 25 shown by the alternate long and short dashed lines in FIG. 11) provided between the tilting origin and the maximum tilt position. The stop position is a position at which the outboard motor 25 does not interfere with the hatch 20 and the platform 202 in the state in which the hatch 203 is closed. In the present preferred embodiment, the stop position is set so that, for example, the lower case 25*a* is positioned just below the closing position of the hatch 203. In the present preferred embodiment, the stop position and the beaching position are set at, for example, the same position. The beaching position is not limited to the same position as the stop position, and may be a position closer to the tilting origin side than the stop position or may be closer to the maximum tilt position side than the stop position.

As shown in FIG. 12, the outboard motor 25 is arranged to be turnable to the left and right around the steering shaft 211 (steering axis) with respect to the hull 201. The marine vessel A2 is steered by turning the outboard motor 25 to the left or right. The steering shaft 211 is a shaft passing through the front portion of the outboard motor 25 and perpendicular or substantially perpendicular to the rotation axis L1 of the propeller 27. The steering shaft 211 is arranged to become, for example, substantially vertical when the tilt angle of the outboard motor 25 around the tilt/trim shaft 210 is zero. The outboard motor 25 is arranged so that the rotation axis L1 of the propeller 27 is turnable to the left and right around the steering origin along the front-rear direction. The outboard motor 25 is arranged to be turnable up and down around the tilt/trim shaft 210 between the tilting origin and the maximum tilt position not only when the outboard motor is at the steering origin but also in a state in which the outboard motor 25 is turned to the left or right. The outboard motor locating hole 205 is shaped so as to prevent the outboard motor 25 from colliding with the hull 201 even when the rightward or leftward steering angle of the outboard motor 25 reaches a maximum value. In FIG. 12, the states where the rightward and leftward steering angles of the outboard motor 25 reach maximum values are shown by the alternate long and two short dashed lines.

The platform 202 is formed to have, for example, a tabular shape bilaterally symmetric. The platform 202 projects rearward from the stern of the hull 201. The platform 202 may be formed by extending a portion of the hull 201 rearward, or may be a member separate from the hull 201. In the present preferred embodiment, the platform 202 preferably is a member separate from the hull 201, and attached to the stern of the hull 201 so as to become substantially horizontal. The attaching position of the platform 202 is set so that the platform 202 becomes slightly higher than the water surface. The upper surface of the platform 202 is formed to have, for example, a flat shape along a horizontal plane. The left, right, and rear sides of the platform 202 are opened. As shown in FIG. 9 and FIG. 10, the portion on the right side of the outboard motor locating hole 205 of the rear portion of the deck 206 is an aisle 212 connecting the cockpit 13 and the platform 202.

An occupant can move between the cockpit 13 and the platform 202 by passing through the aisle 212. An occupant can move between the platform 202 and the water by passing through the left, right, or rear side of the platform 202. The platform 202 is attached to the hull 201 so that the platform 202 becomes slightly higher than the water surface, and an occupant can easily move between the platform 202 and the water by using the platform 202.

The platform 202 has a width (length in the right-left direction), for example, substantially equal to the portion to which the platform 202 is attached of the stern of the hull 201. The width of the platform 202 is gently reduced with increasing distance from the hull 201. The left and right side surfaces of the platform 202 preferably have curved shapes convex outward. The left and right side surfaces of the platform 202 are connected to the left and right side surfaces of the hull 201 without large steps, respectively. The thicknesses (lengths in the up-down direction) of the left and right side surfaces of the platform 202 are gently reduced with increasing distance from the hull 201.

The right end portion and the left end portion of the rear end portion of the platform 202 project rearward. Further, a portion between the right end portion and the left end portion of the rear end portion of the platform 202 is recessed forward. The platform 202 has a notched hole 213 extending rearward from the front end of the platform 202. Portions on the both sides of the notched hole 213 of the front end portion of the platform 202 preferably have shapes along the rear end of the hull 201.

The notched hole 213 penetrates vertically through the platform 202. The notched hole 213 preferably has, for example, a substantially rectangular shape long in the right-left direction in a plan view. The notched hole 213 is disposed at the central portion in the right-left direction of the platform 202. The notched hole 213 has a width, for example, substantially equal to that of the outboard motor locating hole 205. The notched hole 213 is communicatively connected to the outboard motor locating hole 205 from the rear side. A portion at the rear of the notched hole 213 of the upper surface of the platform 202 has a width (length in the front-rear direction) that at least allows an occupant to move in the right-left direction. Therefore, an occupant can move in the right-left direction on the platform 202 even in the state in which the hatch 203 is opened.

For example, when the outboard motor 25 is turned around the tilt/trim shaft 210 from the tilting origin to the maximum tilt position, the lower portion of the outboard motor 25 including the propeller 27 is moved to a position above the platform 202 by passing through the notched hole 213. The size of the notched hole 213 is set so that the lower portion of the outboard motor 25 does not interfere with the platform 202 even when the outboard motor 25 is turned to the maximum tilt position in a state in which the rightward or leftward steering angle of the outboard motor 25 is maximum. Therefore, even when the outboard motor 25 is turned around the tilt/trim shaft 210 in a state in which the outboard motor 25 is steered to an arbitrary steering angle, the lower portion of the outboard motor 25 does not collide with the platform 202. Therefore, an occupant can turn the outboard motor 25 around the tilt/trim shaft 210 without an operation of returning the outboard motor 25 to the steering origin. Therefore, a high level of convenience is obtained.

The hatch 203 includes, for example, a tabular portion 214 and a stepped portion 215. The tabular portion 214 is preferably arranged so as to close the entire notched hole 213. In the present preferred embodiment, the tabular portion 214 preferably has, for example, a substantially rectangular shape long in the right-left direction. The rear end portion of the tabular portion 214 is joined to the platform 202 turnable up and down by a hinge 216 (refer to FIG. 16, a joint member). The hatch 203 is opened and closed vertically between a closing position (the position shown in FIG. 9) and an opening position (the position shown in FIG. 10) around the rear end portion of the tabular portion 214. The hatch 203 is opened or closed by moving up or down a U-shaped handle 217 attached to the stepped portion 215 by an occupant. The hatch 203 is opened or closed when the tilt angle of the outboard motor 25 is not more than a value corresponding to a stop position. Specifically, the outboard motor 25 is arranged to partially enter the notched hole 213 when the tilt angle of the outboard motor 25 becomes more than the value corresponding to the stop position. Therefore, when the tilt angle of the outboard motor 25 is more than the value corresponding to the stop position, the hatch 203 is kept in an opened state.

The stepped portion 215 is provided on the front end portion of the tabular portion 214. The stepped portion 215 has a width (length in the right-left direction) substantially equal to that of the tabular portion 214. The stepped portion 215 is configured to be higher than the tabular portion 214 in the state in which the hatch 203 is closed. The stepped portion 215 is arranged to enter the rear portion of the outboard motor locating hole 205 in the state in which the hatch 203 is closed. The front end portion of the stepped portion 215 preferably has a curved shape that is convex rearward and bilaterally symmetrical along the rear portion of the outboard motor 25. Therefore, in the state in which the hatch 203 is closed, the left and right gaps between the rear portion of the outboard motor 25 and the hull 201 are filled with the stepped portion 215 and reduced in the state in which the hatch 203 is closed. Therefore, occupants are prevented from falling into the outboard motor locating hole 205. Further, in the state in which the hatch 203 is closed, the stepped portion 215 is higher than the tabular portion 214, so that occupants are reliably prevented from falling into the outboard motor locating hole 205.

The hatch 203 is arranged so that the upper surface of the tabular portion 214 is flush with the upper surface of the platform 202 in the state in which the hatch 203 is closed. Therefore, in the state in which the hatch 203 is closed, a wide space is secured by the upper surface of the platform 202 and the upper surface of the hatch 203 (the upper surface of the tabular portion 214). Further, the upper surface of the tabular portion 214 is flush with the upper surface of the platform 202, so that an occupant can smoothly move in the right-left direction on the platform 202 passing through the hatch 203.

Thus, by providing the hatch 203, a wide space is secured at the rear portion of the marine vessel A2 while the length in the front-rear direction of the platform 202 is prevented from increasing. Therefore, the marine vessel A2 is prevented from deteriorating in running performance. Specifically, if the platform 202 is long in the front-rear direction, when the marine vessel A2 runs, the platform 202 may be submerged in water and the running performance of the marine vessel A2 may deteriorate. Therefore, by preventing the length in the front-rear direction of the platform 202 from increasing, a wide space is secured at the rear portion of the marine vessel A2 while the marine vessel A2 is prevented from deteriorating in running performance. When the entire length of the marine vessel A2 is about 9.27 meters, the length in the front-rear direction of the platform 202 is, for example, about 0.8 to about 0.9 meters.

As described above, in the present preferred embodiment, the beaching position is set at the same position as the stop position. Therefore, an occupant can position the outboard motor 25 at the beaching position in the state in which the hatch 203 is closed. Therefore, not only when the outboard motor 25 is in the trim region but also when the outboard motor is at the beaching position, a wide space is secured at the rear portion of the marine vessel A2. Therefore, an occupant can effectively use the wide space secured at the rear portion of the marine vessel A2 when the marine vessel A2 is beached in the state in which the outboard motor 25 is at the beaching position.

Figure 13:
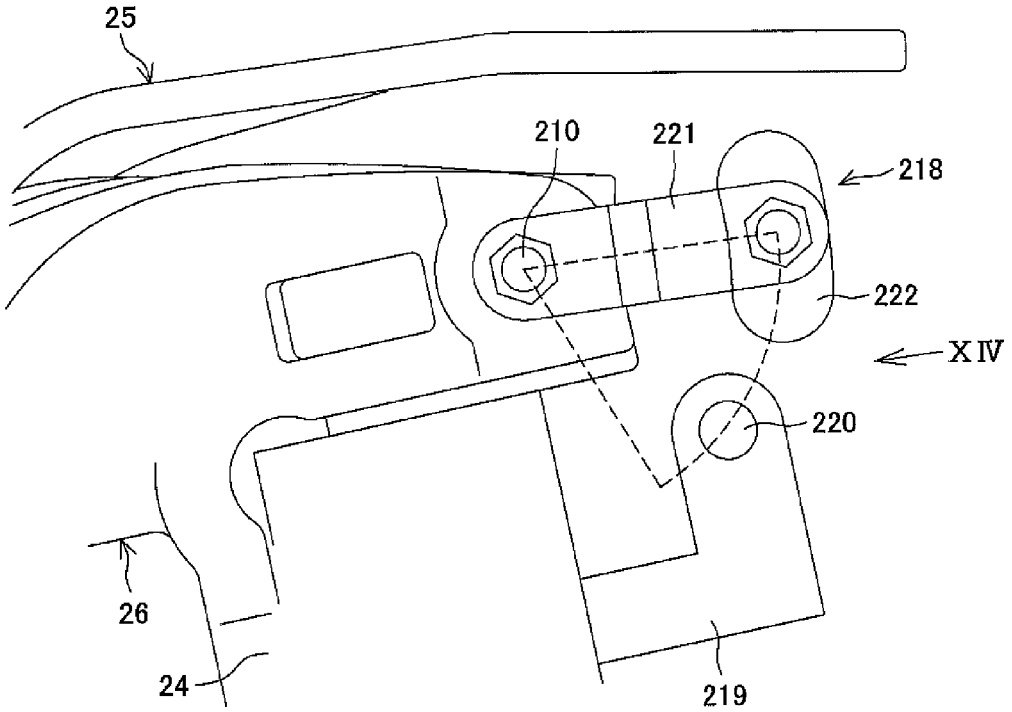
FIG. 13 is a side view of a tilt detection mechanism to detect a tilting state of the outboard motor according to the second preferred embodiment of the present invention.
Figure 14:
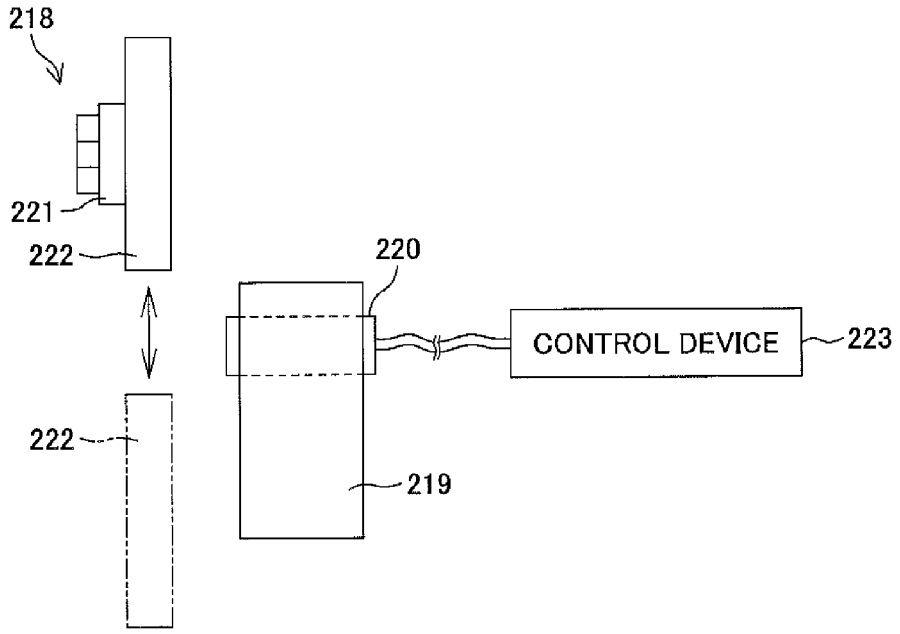
FIG. 14 is a schematic view of the tilt detection mechanism as viewed from the arrow XIV in FIG. 13.

FIG. 13 is a side view of a tilt detection mechanism 218 to detect a tilting state of the outboard motor 25. FIG. 14 is a schematic view of the tilt detection mechanism 218 viewed from the arrow XIV shown in FIG. 13. FIG. 13 and FIG. 14 show a state in which the outboard motor 25 is at the tilting origin.

The marine vessel A2 includes the tilt detection mechanism 218 to detect a tilting state of the outboard motor 25 around the tilt/trim shaft 210. The tilt detection mechanism 218 includes a tilt sensor 220 attached to the mounting portion 24 via a bracket 219, and a detection target 222 attached to the tilt/trim shaft 210 via an arm 221. The tilt sensor 220 may be a non-contact sensor such as a proximity sensor or may be a contact sensor such as a limit switch. In the present preferred embodiment, the tilt sensor 220 preferably is a proximity sensor. As shown in FIG. 14, the tilt sensor 220 is disposed so that its position is deviated from the detection target 222 in the right-left direction. The tilt sensor 220 is electrically connected to a control device 223.

The detection target 222 is arranged to turn around the tilt/trim shaft 210 together with the outboard motor 25. The position of the detection target 222 shown by the solid lines in FIG. 14 is a position when the outboard motor 25 is at the tilting origin. The position of the detection target 222 shown by the alternate long and two short dashed lines in FIG. 14 is a position when the outboard motor 25 is at the maximum tilt position. The detection target 222 turns around the tilt/trim shaft 210 between these positions according to turning of the outboard motor 25 around the tilt/trim shaft 210.

When the tilt angle of the outboard motor 25 becomes not less than the value corresponding to the stop position, a portion of the detection target 222 faces the tilt sensor 220. Accordingly, the tilt sensor 220 is switched to be on and a signal is input into the control device 223 from the tilt sensor 220. Therefore, in the case where the outboard motor 25 is moved from the tilting origin to the maximum tilt position, when the outboard motor 25 reaches the stop position, a signal is input into the control device 223 from the tilt sensor 220. In the case where the outboard motor 25 is moved from the maximum tilt position to the tilting origin, when the outboard motor 25 passes through the stop position, the output of a signal from the tilt sensor 220 is stopped. Therefore, the control device 223 can detect that the outboard motor 25 has reached the stop position based on whether a signal is input from the tilt sensor 220.

Figure 15:
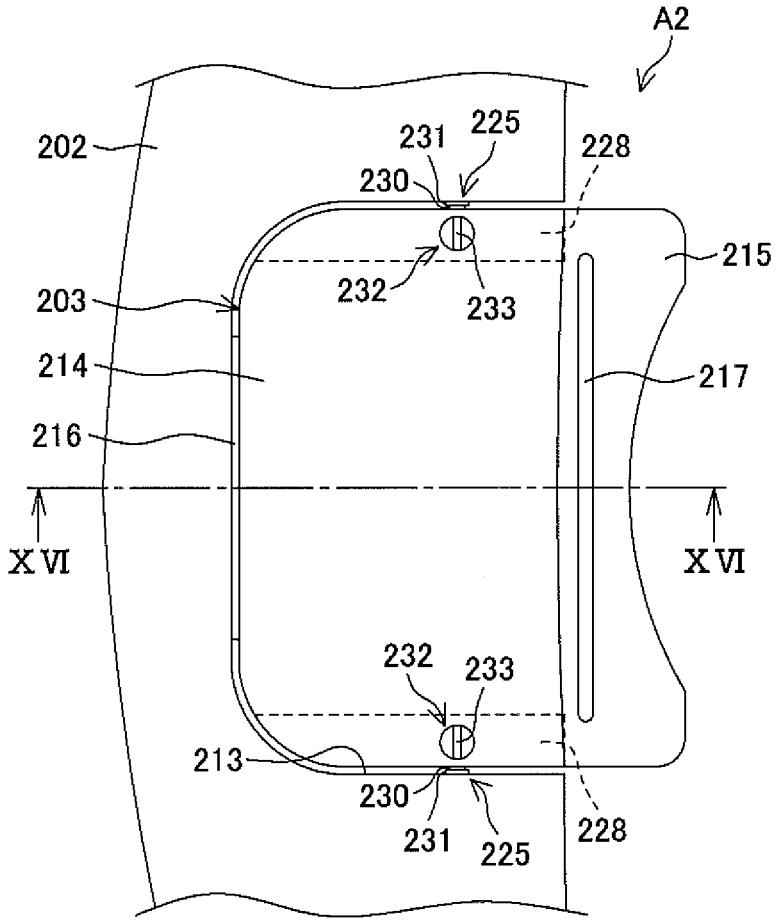
FIG. 15 is a plan view of a hatch and components relating thereto provided in the marine vessel according to the second preferred embodiment of the present invention.
Figure 16:
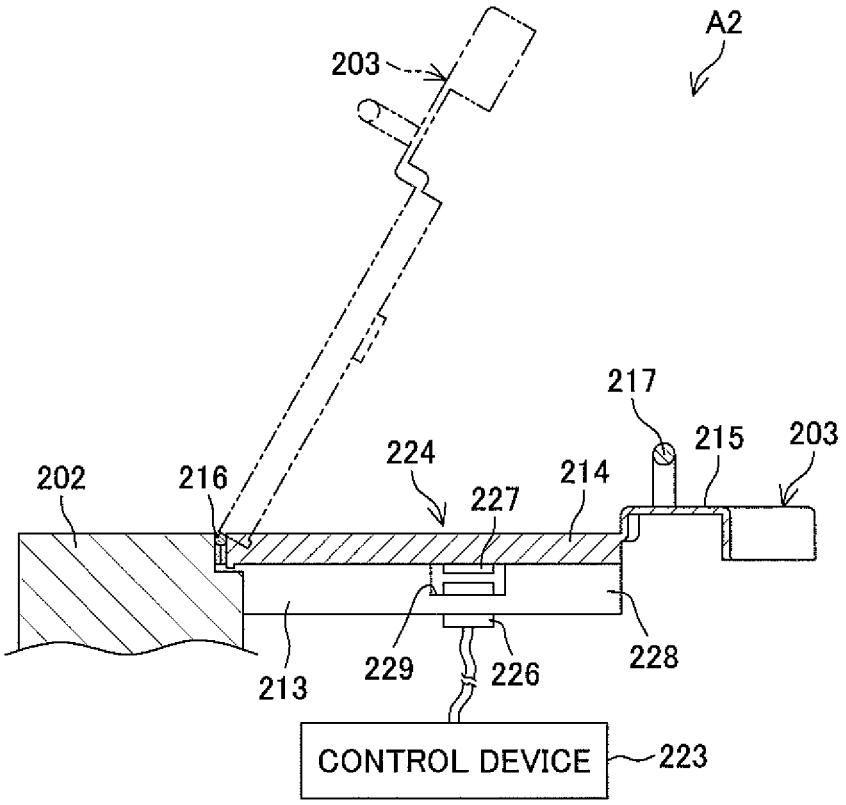
FIG. 16 is a sectional view of the hatch and the components relating thereto taken along line XVI-XVI in FIG. 15.
Figure 17:
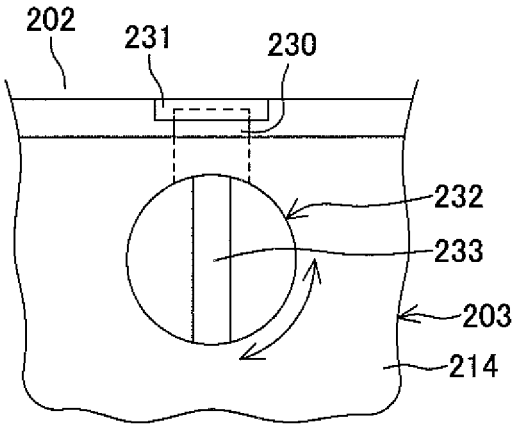
FIG. 17 is an enlarged view of a portion of FIG. 15.

FIG. 15 is a plan view of a hatch 203 and components relating thereto provided in the marine vessel A2 according to the second preferred embodiment of the present invention. FIG. 16 is a sectional view of the hatch 203 and the components relating thereto taken along line XVI-XVI in FIG. 15. FIG. 17 is an enlarged view of a portion of FIG. 15.

The marine vessel A2 includes an opening/closing detection mechanism 224 that detects opening/closing of the hatch 203, and a lock mechanism 225 that locks the hatch 203 in a closed state. The opening/closing detection mechanism 224 includes an opening/closing sensor 226 attached to the platform 202 and a detection target 227 attached to the hatch 203. The opening/closing sensor 226 may be a non-contact sensor such as a proximity sensor, or may be a contact sensor such as a limit switch. In the present preferred embodiment, the opening/closing sensor 226 preferably is a proximity sensor. The opening/closing sensor 226 is attached to one of a pair of support portions 228 provided on the platform 202. The upper end portion of the opening/closing sensor 226 is disposed on the bottom portion of a recess portion 229 provided on one support portion 228.

The detection target 227 is attached to the lower surface of the hatch 203. The detection target 227 is turned up or down together with the hatch 203 when the hatch 203 is opened or closed. When the hatch 203 is closed, the right end portion and the left end portion of the hatch 203 are supported by the pair of support portions 228, respectively. Further, when the hatch 203 is closed, the detection target 227 enters the recess portion 229 and faces the opening/closing sensor 226. Accordingly, the opening/closing sensor 226 is switched to be on and a signal is input into the control device 223 from the opening/closing sensor 226. Therefore, the control device 223 can detect whether the hatch 203 is closed based on whether a signal is input from the opening/closing sensor 226.

The lock mechanism 225 includes two protrusions 230, two engagement members 231, and two operation members 232. The two protrusions 230 are attached to the right end portion and the left end portion of the hatch 203, respectively. The tip end portions of the two protrusions 230 protrude laterally from the right side surface and the left side surface of the hatch 203, respectively. The two engagement members 231 are attached to the platform 202 at positions that are opposed to the two protrusions 230, respectively, when the hatch 203 is closed. The two operation members 232 are attached to the right end portion and the left end portion of the hatch 203, respectively. The two operation members 232 are positioned near the two protrusions 230, respectively. The two operation members 232 may be, for example, turn levers as shown in FIG. 15 to FIG. 17, or may be push buttons. A knob 233 of each operation member 232 is disposed so as not to project from the upper surface of the hatch 203. Each protrusion 230 advances and withdraws when the corresponding operation member 232 is operated by an occupant. In the present preferred embodiment, for example, by turning each operation member 232 90 degrees clockwise or counterclockwise, turning of each operation member 232 is converted into a linear movement of the corresponding protrusion 230 and each protrusion 230 advances or withdraws. When each protrusion 230 is advanced in the state in which the hatch 203 is closed, the tip end portion of each protrusion 230 engages with the corresponding engagement member 231. Accordingly, the hatch 203 is locked in the closed state.

Figure 18:
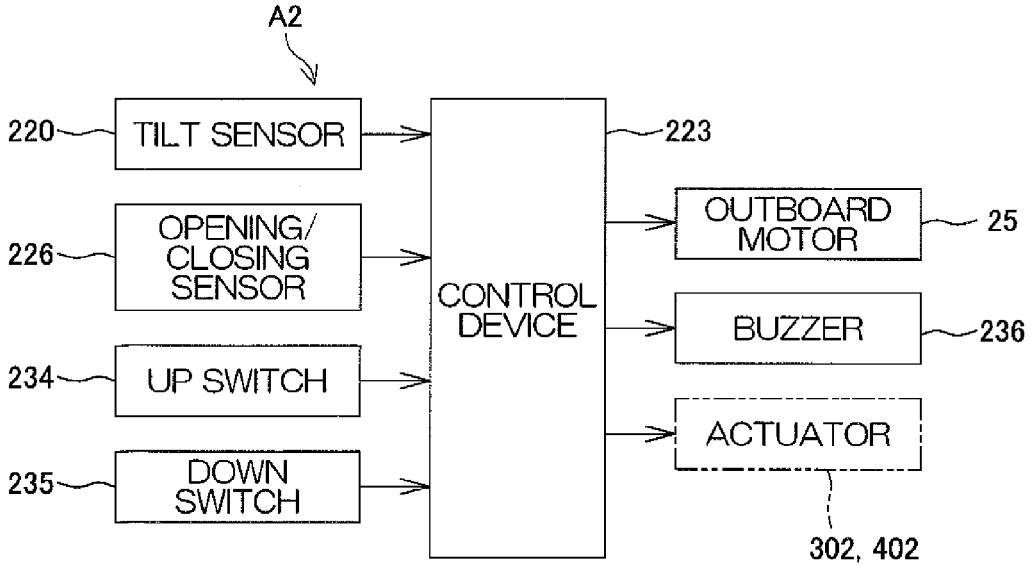
FIG. 18 is a block diagram for describing electrical configuration of the marine vessel according to the second preferred embodiment of the present invention.

FIG. 18 is a block diagram for describing an electrical configuration of the marine vessel A2.

The marine vessel A2 includes a control device 223 including a microcomputer. A plurality of electric components provided in the marine vessel A2 are electrically connected to the control device 223. The plurality of electric components are controlled by the control device 223. In detail, the outboard motor 25, the tilt sensor 220, the opening/closing sensor 226, an up switch 234, a down switch 235, and a buzzer 236 are electrically connected to the control device 223. The outboard motor 25 and the buzzer 236 are controlled by the control device 223. The buzzer 236 is an example of a warning device.

Signals from the tilt sensor 220, the opening/closing sensor 226, the up switch 234, and the down switch 235 are input into the control device 223. The up switch 234 is operated to turn the outboard motor 25 around the tilt/trim shaft 210 (refer to FIG. 11) to move-up the lower portion of the outboard motor 25. The down switch 235 is operated to turn the outboard motor 25 around the tilt/trim shaft 210 to move-down the lower portion of the outboard motor 25. The up switch 234 and the down switch 235 are disposed near the steering mechanism 14 (refer to FIG. 2). The up switch 234 may include a plurality of switches including a trim-up switch and a tilt-up switch, or may be a single switch. Similarly, the down switch 235 may include a plurality of switches including a trim-down switch and a tilt-down switch, or may be a single switch.

Figure 19:
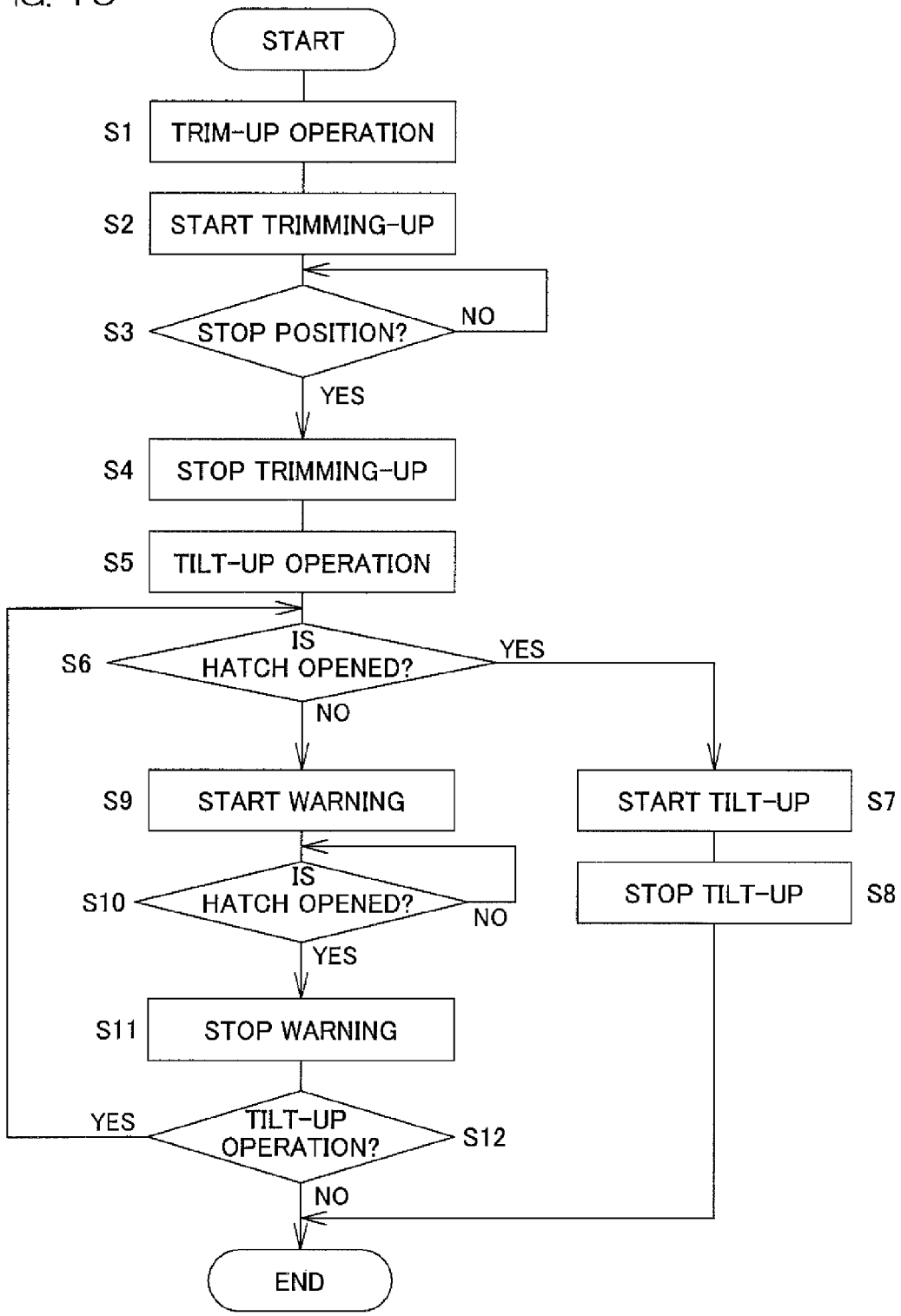
FIG. 19 is a flowchart when the outboard motor is turned from a tilting origin to a maximum tilt position.

FIG. 19 is a flowchart when the outboard motor 25 is turned from the tilting origin to the maximum tilt position. Hereinafter, a flow when the outboard motor 25 is turned from the tilting origin to the maximum tilt position in the marine vessel A2 according to the second preferred embodiment will be described with reference to FIG. 11, FIG. 18, and FIG. 19.

When the up switch 234 is operated by an occupant and a trim-up operation is performed (Step S1), the outboard motor 25 at the tilting origin turns around the tilt/trim shaft 210 and moving up of the lower portion of the outboard motor 25 is started (Step S2). Then, it is judged by the control device 223 whether the outboard motor 25 has reached the stop position based on whether a signal is input from the tilt sensor 220 (Step S3). In detail, in the case where the outboard motor 25 is turned from the tilting origin to the maximum tilt position, when the outboard motor 25 reaches the stop position, a signal from the tilt sensor 220 is input into the control device 223. Therefore, when no signal is input from the tilt sensor 220 into the control device 223 (No in Step S3), it is continuously judged by the control device 223 whether the outboard motor 25 has reached the stop position. In the case where a signal from the tilt sensor 220 has been input into the control device 223 (Yes in Step S3), the control device 223 judges that the outboard motor 25 has reached the stop position and stops turning of the outboard motor 25 (Step S4).

Next, when the up switch 234 is operated by an occupant and a tilt-up operation is performed (Step S5), it is judged by the control device 223 whether the hatch 203 is opened based on whether a signal is input from the opening/closing sensor 226 (Step S6). In detail, when the hatch 203 is opened, no signal is input into the control device 223 from the opening/closing sensor 226. Therefore, when no signal is input from the opening/closing sensor 226 into the control device 223 (Yes in Step S6), the outboard motor 25 at the stop position turns around the tilt/trim shaft 210 and moving up of the lower portion of the outboard motor 25 is started (Step S7). Then, when the outboard motor 25 reaches the maximum tilt position, tilt-up is stopped (Step S8). Specifically, when the lower portion of the outboard motor 25 including the propeller 27 passes through the notched hole 213 and reaches a position above the platform 202, tilt-up is stopped.

On the other hand, when the hatch 203 is not opened (when the hatch 203 is closed), a signal from the opening/closing sensor 226 is input into the control device 223. Therefore, when a signal from the opening/closing sensor 226 is input into the control device 223 (No in Step S6), the buzzer 236 is controlled by the control device 223 and sounds a warning alarm to warn that the hatch 203 is forgotten to be opened (Step S9). Then, while the warning alarm is sounded, it is judged by the control device 223 again whether the hatch 203 is opened (Step S10). At this time, when the hatch 203 is closed (No in Step S10), the warning alarm is continuously sounded. On the other hand, when the hatch 203 is operated and opened by an occupant (Yes in Step S10), the warning alarm is stopped (Step S11).

Next, it is judged by the control device 223 whether a tilt-up operation has been performed based on whether a signal is input from the up switch 234 (Step S12). At this time, when the tilt-up operation is performed (Yes in Step S12), it is judged by the control device 223 again whether the hatch 203 is opened (return to Step S6). Then, when the hatch 203 is opened (Yes in Step S6), tilt-up is started (Step S7), and after the outboard motor 25 reaches the maximum tilt position, tilt-up is stopped (Step S8). On the other hand, if the hatch 203 that was opened by an occupant is closed by, for example, wind, etc., the warning alarm is sounded again (No in Step S6), and the above-described flow is performed again.

Figure 20:
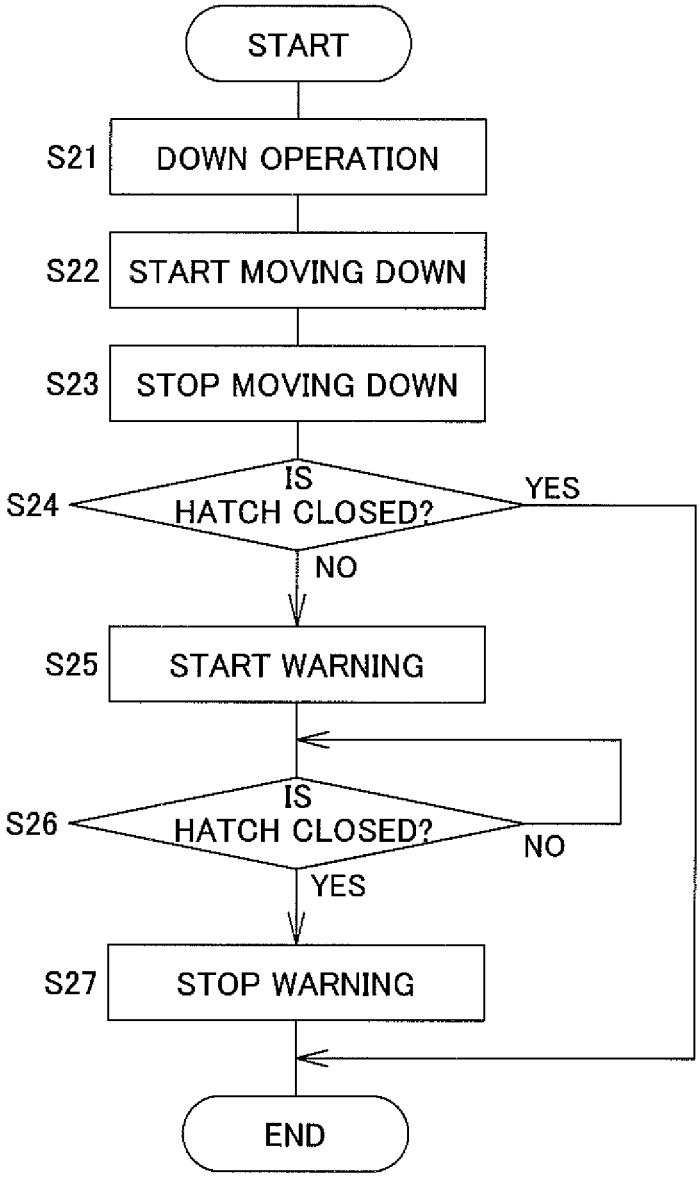
FIG. 20 is a flowchart when the outboard motor is turned from the maximum tilt position to the tilting origin and the hatch is closed.

FIG. 20 is a flowchart when the outboard motor 25 is turned from the maximum tilt position to the tilting origin and the hatch 203 is closed. Hereinafter, a flow when the outboard motor 25 is turned from the maximum tilt position to the tilting origin and the hatch 203 is closed in the marine vessel A2 according to the second preferred embodiment will be described with reference to FIG. 11, FIG. 18, and FIG. 20.

When the outboard motor 25 is at the maximum tilt position, the hatch 203 is kept in an opened state. In this state, when the down switch 235 is operated by an occupant and a down operation is performed (Step S21), the outboard motor 25 at the maximum tilt position turns around the tilt/trim shaft 210 and moving down of the outboard motor 25 is started (Step S22). Then, when the outboard motor 25 reaches the tilting origin, turning of the outboard motor 25 is stopped (Step S23). Thereafter, it is judged by the control device 223 whether the hatch 203 is closed based on whether a signal is input from the opening/closing sensor 226 (Step S24).

When the hatch 203 is not closed (No in Step S24), the buzzer 236 is controlled by the control device 223 to sound a warning alarm to warn that the hatch 203 has been forgotten to be closed (Step S25). Then, while the warning alarm is sounded, it is judged by the control device 223 again whether the hatch 203 is closed (Step S26). At this time, when the hatch 203 is not closed (No in Step S26), the warning alarm is continuously sounded. When the hatch 203 is closed (Yes in Step S26), the warning alarm is stopped (Step S27).

As described above, in the present preferred embodiment, the platform. 202 is attached to the stern of the hull 201. An occupant can freely use the space on the platform 202. The notched hole 213 provided in the platform 202 is closed by the hatch 203. An occupant can freely use the space on the hatch 203 as well. Therefore, a wide space that an occupant can freely use is secured at the rear portion of the marine vessel A2. Further, the hatch 203 is joined to the platform 202 in an openable and closable manner. Therefore, as long as the hatch 203 is opened, the hatch 203 does not become an obstacle when the outboard motor 25 is turned to the maximum tilt position.

In the present preferred embodiment, the upper surface of the tabular portion 214 of the hatch 203 is disposed to be flush with the upper surface of the platform 202 in the state in which the hatch 203 is closed. Therefore, in the state in which the hatch 203 is closed, a flat wide space is defined by the upper surface of the platform 202 and a portion of the upper surface of the hatch 203. An occupant can smoothly move within this wide space. Therefore, a highly-convenient and wide space is secured at the rear portion of the marine vessel A2.

In the present preferred embodiment, the control device 223 detects a tilting state of the outboard motor 25 based on a detection value of the tilt sensor 220. The control device 223 detects opening/closing of the hatch 203 based on a detection value of the opening/closing sensor 226. Further, unless the hatch 203 is opened when the outboard motor 25 is turned around the tilt/trim shaft 210 to move the lower portion of the outboard motor 25 upward, the control device 223 stops turning of the outboard motor 25 when the lower portion of the outboard motor 25 moves to a position (stop position) just in front of the notched hole 213. Accordingly, the hatch 203 and the outboard motor 25 are prevented from being broken or damaged by a collision with the outboard motor 25.

Third Preferred Embodiment

Figure 21:
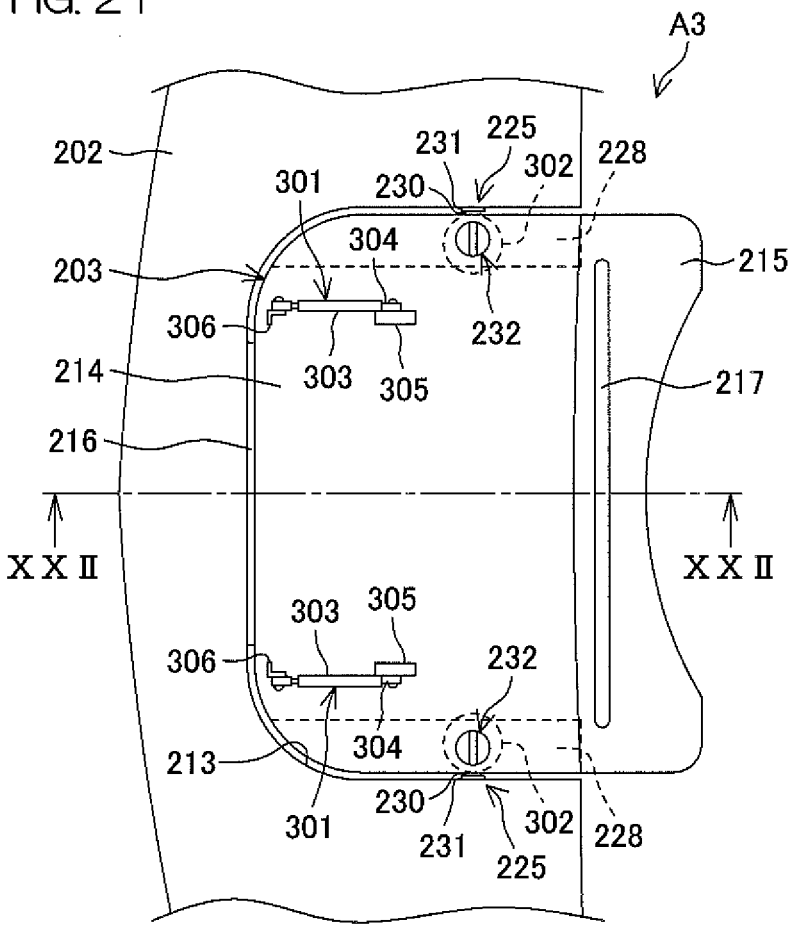
FIG. 21 is a plan view of a hatch and components relating thereto provided in a marine vessel according to a third preferred embodiment of the present invention.
Figure 22:
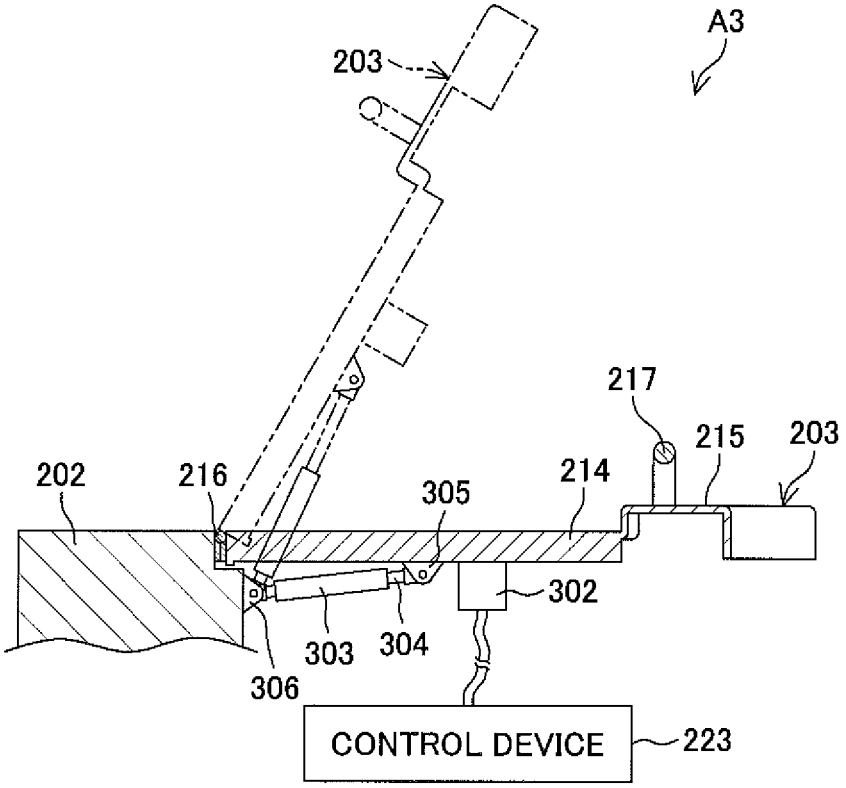
FIG. 22 is a sectional view of the hatch and components relating thereto taken along line XXII-XXII in FIG. 21.

FIG. 21 is a plan view of a hatch 203 and components relating thereto provided in the marine vessel A3 according to a third preferred embodiment of the present invention. FIG. 22 is a sectional view of the hatch 203 and components relating thereto taken along line XXII-XXII in FIG. 21. In FIG. 21 and FIG. 22, components equivalent to the components shown in FIG. 1 to FIG. 20 described above are denoted by the same reference numerals as in FIG. 1 and description thereof will be omitted. In FIG. 21 and FIG. 22, an illustration of the opening/closing detection mechanism 224 (refer to FIG. 16) is omitted.

A major difference between the third preferred embodiment and the above-described second preferred embodiment is that the hatch 203 is arranged to be automatically opened. The marine vessel A3 includes two pressing members 301, the above-described lock mechanism 225, and two actuators 302 (opening actuators). In the present preferred embodiment, the lock mechanism 225 and the two actuators 302 constitute an opening mechanism.

The two pressing members 301 are disposed at an interval in the right-left direction. In FIG. 21, the two pressing members 301 are disposed below the hatch 203, and the two pressing members 301 and components relating thereto are shown by solid lines. Each pressing member 301 includes a cylinder 303 and a rod 304. One end portion of the rod 304 is housed inside the cylinder 303. The other end portion of the rod 304 is joined turnable to the lower surface of the hatch 203 via a stay 305. An end portion of the cylinder 303 on the opposite side of the rod 304 is joined to be turnable up and down to the platform 202 via the stay 306. Each pressing member 301 is arranged to press the hatch 203 in a direction in which the hatch 203 opens. Therefore, in a state in which the hatch 203 is unlocked by the lock mechanism 225, the hatch 203 is opened by pressing forces of the two pressing members 301. The magnitudes of the pressing forces of the two pressing members 301 are set so as to allow a force of a person to close the hatch 203.

The lock mechanism 225 includes the above-described two protrusions 230, two engagement members 231, and two operation members 232. Two protrusions 230 are joined to two actuators 302, respectively, although this is not shown. Each actuator 302 is, for example, a motor. Each actuator 302 is connected to the control device 223. When each actuator 302 is controlled by the control device 223 and the rotary shaft (not shown) of each actuator 302 turns clockwise or counterclockwise, each protrusion 230 advances or withdraws. Therefore, in the state in which the hatch 203 is closed, when each actuator 302 is controlled and each protrusion 230 advances, the tip end portion of each protrusion 230 engages with the corresponding engagement member 231 and the hatch 203 is locked. When each actuator 302 is controlled and each protrusion 230 withdraws in the state in which the hatch 203 is locked, the hatch 203 is unlocked. Accordingly, the hatch 203 is opened by the pressing forces of the two pressing members 301.

Figure 23:
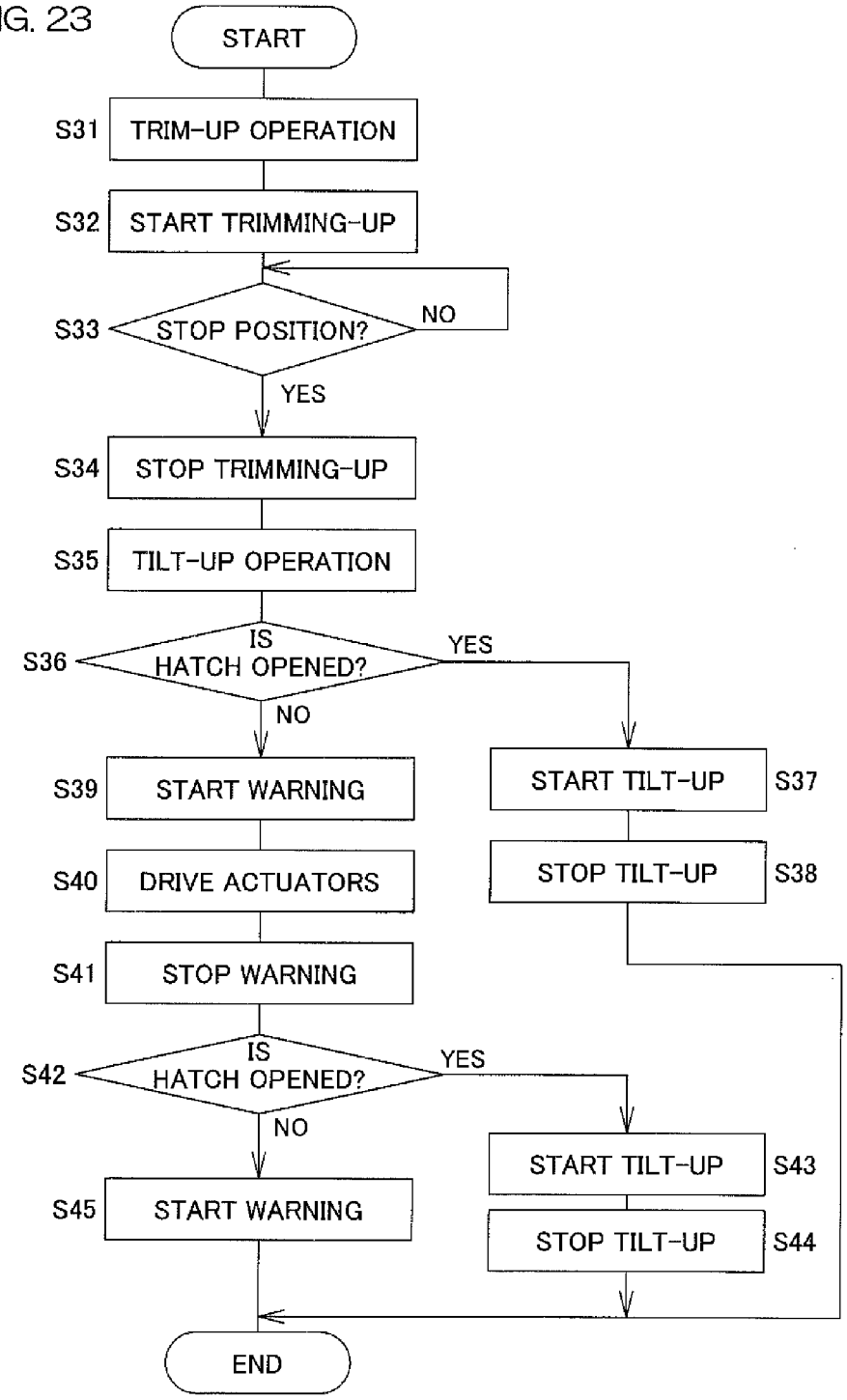
FIG. 23 is a flowchart when the outboard motor is turned from the tilting origin to the maximum tilt position.

FIG. 23 is a flowchart when the outboard motor 25 is turned from the tilting origin to the maximum tilt position. Hereinafter, a flow when the outboard motor 25 is turned from the tilting origin to the maximum tilt position in the marine vessel A3 according to the third preferred embodiment will be described with reference to FIG. 11, FIG. 18, and FIG. 23.

When the up switch 234 is operated by an occupant and a trim-up operation is performed (Step S31), the outboard motor 25 at the tilting origin turns around the tilt/trim shaft 210 and moving up of the lower portion of the outboard motor 25 is started (Step S32). Then, it is judged by the control device 223 whether the outboard motor 25 has reached the stop position based on whether a signal is input from the tilt sensor 220 (Step S33). In detail, when the outboard motor 25 is turned from the tilting origin to the maximum tilt position and the outboard motor 25 reaches the stop position, a signal from the tilt sensor 220 is input into the control device 223. Therefore, when no signal is input from the tilt sensor 220 into the control device 223 (No in Step S33), it is continuously judged by the control device 223 whether the outboard motor 25 has reached the stop position. When a signal from the tilt sensor 220 is input into the control device 223 (Yes in Step S33), the control device 223 judges that the outboard motor 25 has reached the stop position and stops turning of the outboard motor 25 (Step S34: stopping step).

Next, when a tilt-up operation is performed (Step S35), in the state in which the outboard motor 25 is stopped at the stop position, it is judged by the control device 223 whether the hatch 203 is opened (Step S36: opening/closing detection step). In detail, when the hatch 203 is opened, no signal is input from the opening/closing sensor 226 into the control device 223. Therefore, when no signal is input from the opening/closing sensor 226 into the control device 223 (Yes in Step S36), the outboard motor 25 at the stop position turns around the tilt/trim shaft 210 and moving up of the lower portion of the outboard motor 25 is started (Step S37: moving-up step). Then, when the outboard motor 25 reaches the maximum tilt position, tilt-up is stopped (Step S38). Specifically, when the lower portion of the outboard motor 25 including the propeller 27 passes through the notched hole 213 and reaches a position above the platform 202, tilt-up is stopped.

On the other hand, when the hatch 203 is locked by the lock mechanism 225 and the hatch 203 is not opened, a signal from the opening/closing sensor 226 is input into the control device 223. Therefore, when a signal from the opening/closing sensor 226 is input into the control device 223 (No in Step S36), the buzzer 236 is controlled by the control device 223 to sound a warning alarm to warn that the hatch 203 will be automatically opened (Step S39). Then, while the warning alarm is sounded, the two actuators 302 are driven by the control device 223 (Step S40: opening step). Accordingly, in the state in which the outboard motor 25 is stopped at the stop position, the hatch 203 is unlocked, and the hatch 203 is opened by pressing forces of the two pressing members 301 (refer to FIG. 21). Then, the warning alarm is stopped (step S41). The warning alarm may be stopped after a predetermined time elapses from driving of the two actuators 302, or may be stopped at a timing at which opening of the hatch 203 is detected.

After the warning alarm is stopped, it is judged by the control device 223 again whether the hatch 203 is opened (Step S42). At this time, when the hatch 203 is opened (Yes in Step S42), tilt-up is started (Step S43: moving-up step), and tilt-up is stopped after the outboard motor 25 reaches the maximum tilt position (Step S44). On the other hand, for example, when the hatch 203 is not unlocked due to malfunction, etc., of the two actuators 302 and is left closed, a warning alarm warning of an abnormality of the two actuators 302 is sounded from the buzzer 236 (Step S45).

Next, a flow when the outboard motor 25 is turned from the maximum tilt position to the tilting origin and the hatch 203 is closed in the marine vessel A3 according to the third preferred embodiment will be described with reference to FIG. 11, FIG. 18, and FIG. 20.

When the outboard motor 25 is at the maximum tilting position, the hatch 203 is kept in an opened state. In this state, when the down switch 235 is operated by an occupant and a down operation is performed (Step S21), the outboard motor 25 at the maximum tilt position turns around the tilt/trim shaft 210, and moving down of the lower portion of the outboard motor 25 is started (Step S22). Then, when the outboard motor 25 reaches the tilting origin, turning of the outboard motor 25 is stopped (S23). Thereafter, it is judged by the control device 223 whether the hatch 203 is closed based on whether a signal is input from the opening/closing sensor 226 (Step S24).

When the hatch 203 is not closed (No in Step S24), the buzzer 236 is controlled by the control device 223 and a warning alarm to warn that the hatch 203 is forgotten to be closed is sounded (Step S25). Then, while the warning alarm is sounded, it is judged by the control device 223 again whether the hatch 203 is closed (Step S26). At this time, when the hatch 203 is not closed (No in Step S26), the warning alarm is continuously sounded. When the hatch 203 is closed (Yes in Step S26), the warning alarm is stopped (Step S27). Locking of the hatch 203 after the hatch 203 is closed by an occupant may be performed by operating the two operation members 232 (refer to FIG. 21) by the occupant or may be automatically performed by controlling the two actuators 302 (refer to FIG. 21) by the control device 223.

As described above, in the present preferred embodiment, the control device 223 performs the opening/closing detection step when the outboard motor 25 is turned until the lower portion of the outboard motor 25 moves to a position above the platform 202. Specifically, the control device 223 detects whether the hatch 203 is opened based on detection values of the tilt sensor 220 and the opening/closing sensor 226 before the lower portion of the outboard motor 25 passes through the notched hole 213. The control device 223 performs the opening step when the hatch 203 is not opened in the opening/closing detection step. Specifically, by controlling the actuators 302, the hatch 203 is opened before the lower portion of the outboard motor 25 passes through the notched hole 213. Then, by performing the moving-up step, the control device 223 makes the lower portion of the outboard motor 25 pass through the notched hole 213 in the state in which the hatch 203 is opened. Accordingly, the lower portion of the outboard motor 25 is moved to a position above the platform 202 without colliding with the hatch 203. Thus, in the present preferred embodiment, the hatch 203 is automatically opened, so that a high level of convenience is obtained. Further, the hatch 203 is opened before the lower portion of the outboard motor 25 passes through the notched hole 213, so that the lower portion of the outboard motor 25 is reliably prevented from colliding with the hatch 203. Accordingly, the hatch 203 and the outboard motor 25 are prevented from being broken or damaged.

In the present preferred embodiment, in the case where the lower portion of the outboard motor 25 is moved upward by turning the outboard motor 25, when the hatch 203 is not opened, the control device 223 performs the stopping step. Specifically, when the lower portion of the outboard motor 25 is moved to a position (stop position) just in front of the notched hole 213, the control device 223 stops turning of the outboard motor 25. Then, the control device 223 performs the opening/closing detection step and the opening step in the state in which turning of the outboard motor 25 is stopped. Specifically, the control device 223 detects opening/closing of the hatch 203 in the state in which the lower portion of the outboard motor 25 is stopped at a position (stop position) just in front of the notched hole 213. Then, when the hatch 203 is not opened, the control device 223 opens the hatch 203 by controlling the actuators 302. Accordingly, the hatch 203 and the outboard motor 25 are reliably prevented from being broken or damaged by a collision with the outboard motor 25.

Fourth Preferred Embodiment

Figure 24:
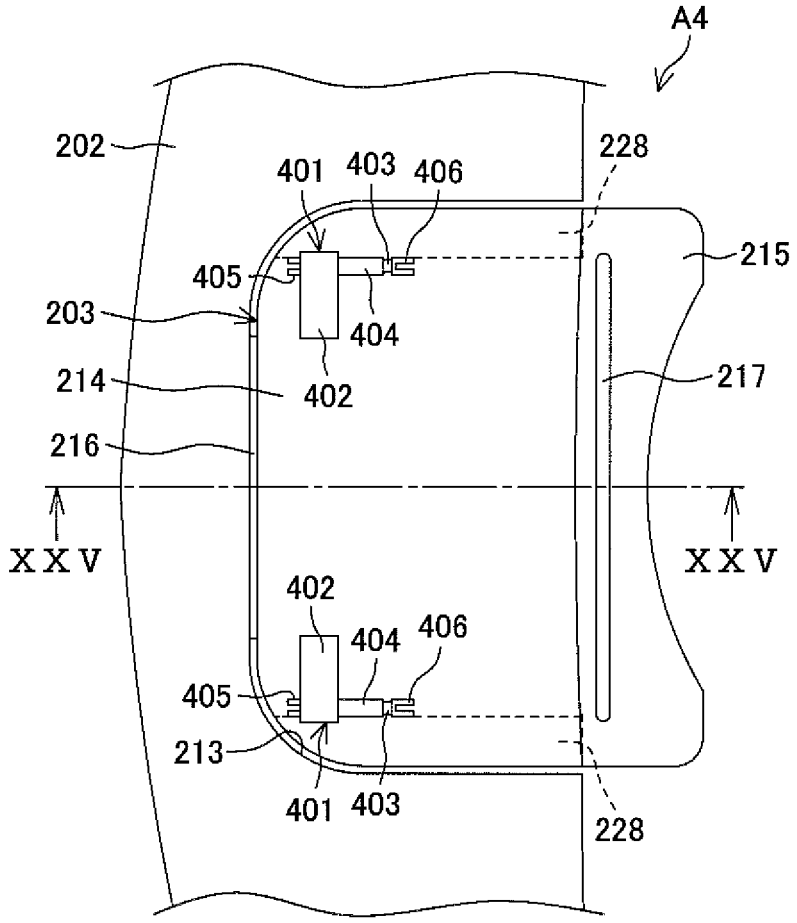
FIG. 24 is a plan view of a hatch and components relating thereto provided in a marine vessel according to a fourth preferred embodiment of the present invention.
Figure 25:
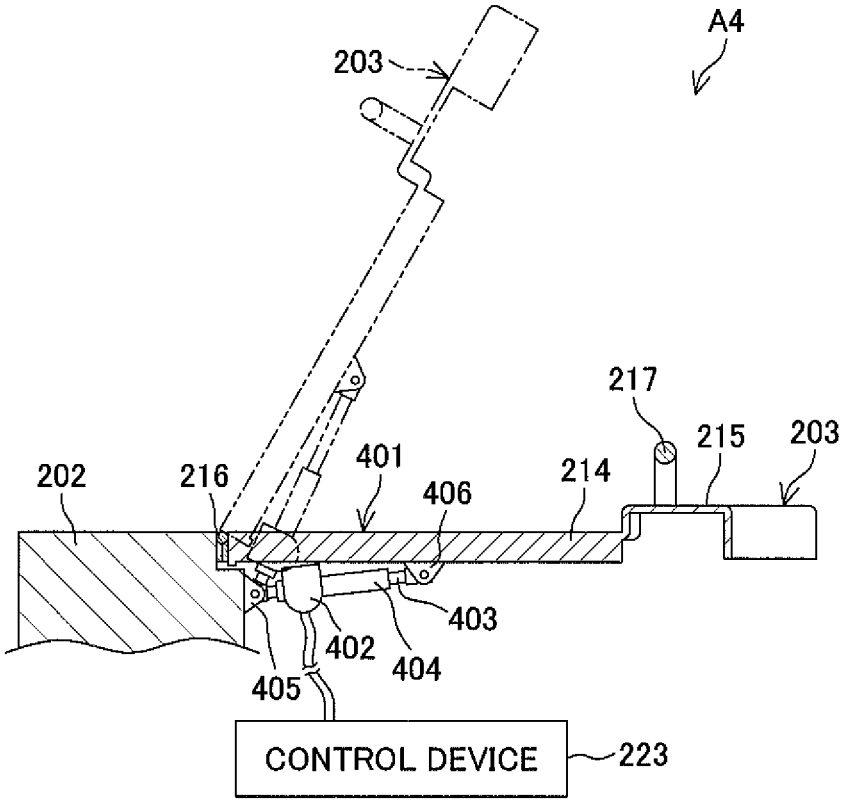
FIG. 25 is a sectional view of the hatch and components relating thereto taken along line XXV-XXV in FIG. 24.

FIG. 24 is a plan view of a hatch 203 and components relating thereto provided in a marine vessel A4 according to a fourth preferred embodiment of the present invention. FIG. 25 is a sectional view of the hatch 203 and components relating thereto taken along line XXV-XXV in FIG. 24. In FIG. 24 and FIG. 25, components equivalent to the components shown in FIG. 1 to FIG. 23 described above are denoted by the same reference numerals as in FIG. 1, etc., and description thereof will be omitted.

A major difference between this fourth preferred embodiment and the above-described second preferred embodiment is that the hatch 203 is arranged to be automatically opened and closed. The marine vessel A4 includes two opening/closing mechanisms 401 (an opening mechanism and a closing mechanism). In FIG. 24, each opening/closing mechanism 401 is disposed below the hatch 203, and each opening/closing mechanism 401 is shown by the solid lines. Each opening/closing mechanism 401 includes an actuator 402 (an opening actuator, a closing actuator, an opening/closing sensor), a rod 403, and a housing 404 in which a transmission mechanism not shown is housed. Each actuator 402 is, for example, a servo motor. Each actuator 402 is connected to the control device 223. Each actuator 402 is joined to the platform 202 via a stay 405 turnable up and down. Each actuator 402 is joined to the rod 403 via the housing 404. An end portion of each rod 403 on the opposite side of the actuator 402 is joined turnable to the lower surface of the hatch 203 via the stay 406.

Each transmission mechanism is, for example, a ball screw mechanism, a gear mechanism, a pulley-belt mechanism, or the like. In the present preferred embodiment, each transmission mechanism is a ball screw mechanism. Each transmission mechanism includes a ball screw, a ball nut, and a plurality of rolling elements although these are not shown. Each actuator 402 is joined to a corresponding ball screw. Each ball screw is rotated by the corresponding actuator 402. Each ball nut is joined to the corresponding rod 403. Each rod 403 moves together with the corresponding ball nut when the corresponding ball screw is rotated. Each rod 403 is arranged to advance and withdraw with respect to the corresponding housing 404 when the corresponding ball screw is rotated.

The hatch 203 is arranged to be opened and closed by driving of the two actuators 402. In a state in which the two actuators 402 are not driven, the movement in the opening/closing direction of the hatch 203 is restricted by mechanical resistances from the opening/closing mechanisms 401 and the actuators 402. Therefore, in the present preferred embodiment, even without the above-described lock mechanism 225, the hatch 203 is locked. The control device 223 controls the two actuators 402 so that the hatch 203 turns between an opening position (the position of the hatch 203 shown by the alternate long and two short dashed lines in FIG. 25) and a closing position (the position of the hatch 203 shown by the solid lines in FIG. 25). The position of the hatch 203 in the opening/closing direction is detected based on, for example, the number of pulse signals input into each actuator 402 from the control device 223. Specifically, in the present preferred embodiment, each actuator 402 functions as an opening/closing sensor. The number of pulse signals input into each actuator 402 is stored in the control device 223. The marine vessel A4 may be arranged to detect the opening/closing of the hatch 203 by the above-described opening/closing detection mechanism 224 (refer to FIG. 16). Next, a flow when the outboard motor 25 is turned from the maximum tilt position to the tilting origin and the hatch 203 is closed in the marine vessel A4 according to the fourth preferred embodiment will be described with reference to FIG. 11, FIG. 18, and FIG. 23.

When the up switch 234 is operated by an occupant and a trim-up operation is performed (Step S31), the outboard motor 25 at the tilting origin turns around the tilt/trim shaft 210 and moving up of the lower portion of the outboard motor 25 is started (Step S32). Then, it is judged by the control device 223 whether the outboard motor 25 has reached the stop position based on whether a signal is input from the tilt sensor 220 (Step S33). In detail, in the case where the outboard motor 25 is turned from the tilting origin to the maximum tilt position, when the outboard motor 25 reaches the stop position, a signal from the tilt sensor 220 is input into the control device 223. Therefore, when no signal is input from the tilt sensor 220 into the control device 223 (No in Step S33), it is continuously judged by the control device 223 whether the outboard motor 25 has reached the stop position. When a signal from the tilt sensor 220 is input into the control device 223 (Yes in Step S33), the control device 223 judges that the outboard motor 25 has reached the stop position and stops turning of the outboard motor 25 (Step S34: stopping step).

Next, when a tilt-up operation is performed (Step S35), in the state in which the outboard motor 25 is stopped at the stop position, it is judged by the control device 223 whether the hatch 203 is opened (Step S36: opening/closing detection step). In detail, when the number of pulse signals stored in the control device 223 is a number corresponding to the state in which the hatch 203 is at the opening position (Yes in Step S36), the outboard motor 25 at the stop position turns around the tilt/trim shaft 210 and moving up of the lower portion of the outboard motor 25 is started (Step S37: moving-up step). Then, when the outboard motor 25 reaches the maximum tilt position, tilt-up is stopped (Step S38). Specifically, when the lower portion of the outboard motor 25 including the propeller 27 passes through the notched hole 213 and reaches a position above the platform 202, tilt-up is stopped.

On the other hand, when the number of pulse signals stored in the control device 223 is not the number corresponding to the state in which the hatch 203 is at the opening position (No in Step S36), the buzzer 236 is controlled by the control device 223. Accordingly, a warning alarm to warn that the hatch 203 will be automatically opened is sounded (Step S39). Then, while the warning alarm is sounded, the two actuators 402 are driven by the control device 223 (Step S40: opening step). Accordingly, the hatch 203 is opened in the state in which the outboard motor 25 is stopped at the stop position. Then, the warning alarm is stopped (Step S41). The warning alarm may be stopped, for example, after a predetermined time elapses from driving of the two actuators 402, or may be stopped at a timing at which opening of the hatch 203 is detected.

After the warning alarm is stopped, it is judged by the control device 223 again whether the hatch 203 is opened (Step S42). At this time, when the hatch 203 is opened (Yes in Step S42), tilt-up is started (Step S43: moving-up step), and after the outboard motor 25 reaches the maximum tilt position, tilt-up is stopped (Step S44). On the other hand, when the hatch 203 is left closed due to, for example, malfunction, etc., of the two actuators 402, a warning alarm to warn of an abnormality of the two actuators 402 is sounded from the buzzer 236 (Step S45).

Figure 26:
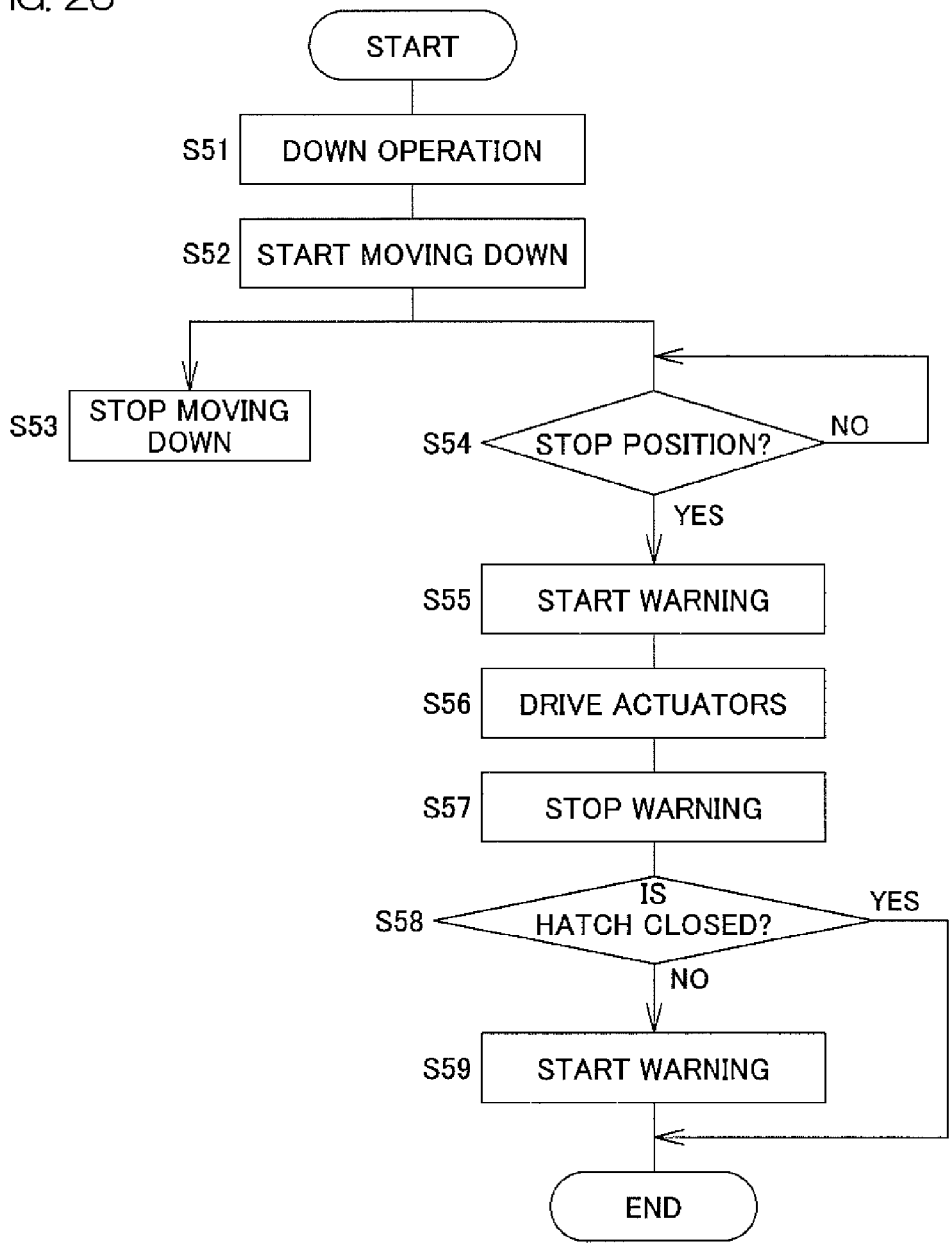
FIG. 26 is a flowchart when the outboard motor is turned from the maximum tilt position to the tilting origin and the hatch is closed.

FIG. 26 is a flowchart when the outboard motor 25 is turned from the maximum tilt position to the tilting origin and the hatch 203 is closed. Hereinafter, a flow when the outboard motor 25 is turned from the maximum tilt position to the tilting origin and the hatch 203 is closed in the marine vessel A4 according to the fourth preferred embodiment will be described with reference to FIG. 11, FIG. 18, and FIG. 26.

When the outboard motor 25 is at the maximum tilt position, the hatch 203 is kept in an opened state. In this state, when the down switch 235 is operated by an occupant and a down operation is performed (Step S51), the outboard motor 25 at the maximum tilt position turns around the tilt/trim shaft 210 and moving down of the lower portion of the outboard motor 25 is started (Step S52: moving-down step). Then, when the outboard motor 25 reaches the tilting origin, turning of the outboard motor 25 is stopped (Step S53). On the other hand, in parallel with turning of the outboard motor 25, it is judged by the control device 223 whether the outboard motor 25 has reached the stop position based on whether a signal is input from the tilt sensor 220 (Step S54: passage detection step).

When the outboard motor 25 is turned from the maximum tilt position to the tilting origin, if the outboard motor 25 turns beyond the stop position, the output of a signal from the tilt sensor 220 to the control device 223 is stopped. Therefore, when a signal is input from the tilt sensor 220 into the control device 223 (No in Step S54), it is continuously judged by the control device 223 whether the outboard motor 25 has reached the stop position. On the other hand, when the output of a signal from the tilt sensor 220 into the control device 223 is stopped (Yes in Step S54), the buzzer 36 is controlled by the control device 223 and sounds a warning alarm to warn that the hatch 203 will be automatically closed (Step S55). Then, while the warning alarm is sounded, the two actuators 402 are driven by the control device 223 (Step S56: closing step). Accordingly, the hatch 203 is closed in the state in which the outboard motor 25 is positioned between the stop position and the tilting origin. Then, the warning alarm is stopped (Step S57). The warning alarm may be stopped, for example, after a predetermined time elapses from driving of the two actuators 402, or may be stopped at a timing at which opening of the hatch 203 is detected.

After the warning alarm is stopped, it is judged by the control device 223 whether the hatch 203 is closed (Step S58). At this time, the hatch 203 that should be closed is not closed due to, for example, malfunction, etc., of the two actuators 402 (No in Step S58), a warning alarm to warn of an abnormality of the two actuators 402 is sounded from the buzzer 236 (Step S59).

As described above, in the present preferred embodiment, as in the case of the above-described third preferred embodiment, when the outboard motor 25 is turned until the lower portion of the outboard motor 25 moves to a position above the platform 202, the control device 223 automatically opens the hatch 203 by controlling the actuators 402. Therefore, a high level of convenience is obtained. Further, the hatch 203 is opened in the state in which the lower portion of the outboard motor 25 is stopped at a position (stop position) just in front of the notched hole 213, so that the lower portion of the outboard motor 25 is reliably prevented from colliding with the hatch 203. Accordingly, the hatch 203 and the outboard motor 25 are prevented from being broken or damaged.

In the present preferred embodiment, when the outboard motor 25 is turned until the lower portion of the outboard motor 25 moves from a position above the platform 202 to a position below the platform 202, the control device 223 performs the moving-down step. Specifically, the control device 223 makes the lower portion of the outboard motor 25 pass through the notched hole 213 in the state in which the hatch 203 is opened. Then, by performing the passage detection step, the control device 223 detects that the lower portion of the outboard motor 25 has passed through the notched hole 213 based on a detection value of the tilt sensor 220 in the moving-down step. At this time, when it is detected that the lower portion of the outboard motor 25 has passed through the notched hole 213, the control device 223 performs the closing step after the detection of the passage. Specifically, the control device 223 closes the hatch 203 by controlling the actuators 402. Thus, with this arrangement, the hatch 203 is automatically closed, so that a high level of convenience is obtained. Further, the hatch 203 is closed after the lower portion of the outboard motor 25 passes through the notched hole 213, so that the hatch 203 is reliably prevented from colliding with the lower portion of the outboard motor 25. Accordingly, the hatch 203 and the outboard motor 25 are prevented from being broken or damaged.

The preferred embodiments of the present invention are described above, however, the present invention is not limited to the contents of the above-described preferred embodiments, and can be variously modified within the scope of the claims. For example, in the first to fourth preferred embodiments described above, a case in which each of the marine vessels A1 to A4 preferably includes one outboard motor 25 is described. However, each of the marine vessels A1 to A4 may include a plurality of outboard motors 25. In detail, each of the marine vessels A1 to A4 may include two or more outboard motors 25 disposed alongside each other in the right-left direction, for example.

Figure 27:
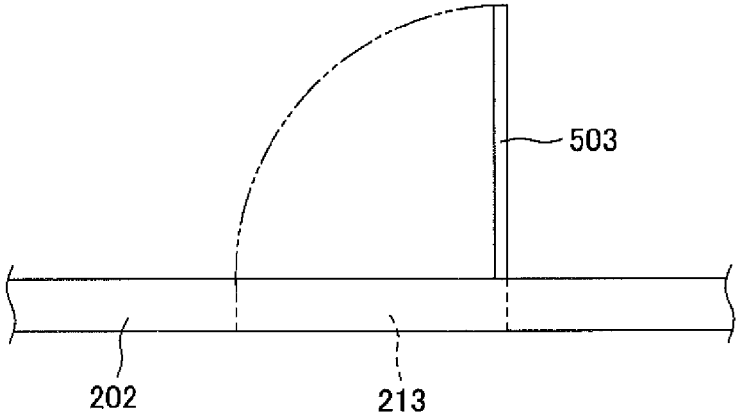
FIG. 27 is a view of a hatch and components relating thereto according to another preferred embodiment of the present invention from the rear side.
Figure 28:
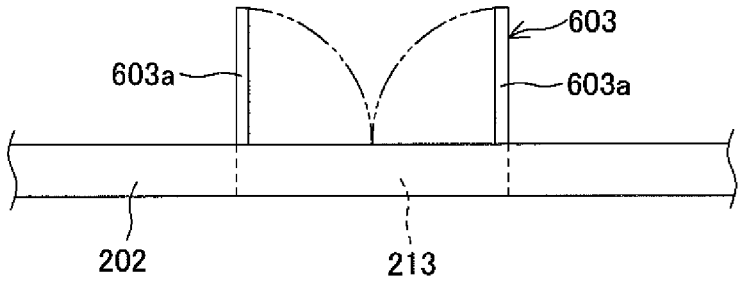
FIG. 28 is a view of a hatch and components relating thereto according to still another preferred embodiment of the present invention from the rear side.
Figure 29:
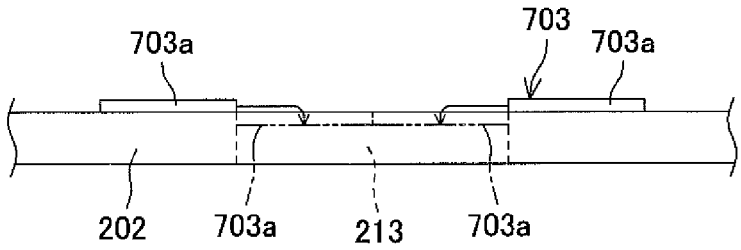
FIG. 29 is a view of a hatch and components relating thereto according to still another preferred embodiment of the present invention from the rear side.

In the second to fourth preferred embodiments described above, a case where the hatch 203 is arranged preferably to be turned up and down along the front-rear direction is described. However, the opening/closing direction of the hatch 203 is not limited to this. For example, as shown in FIG. 27, the hatch 503 may be arranged to be turned up and down along the right-left direction. As shown in FIG. 28, the hatch 603 may include two divisions 603*a* attached to the platform 202 so as to open up and down outward along the right-left direction. Alternatively, as shown in FIG. 29, the hatch 703 may include two sliding members 703*a* arranged to enter the notched hole 213 from above by sliding to the left and right along the upper surface of the platform 202.

In the second to fourth preferred embodiments described above, a case where a tilt detection mechanism 218 is preferably provided separately from components of the outboard motor 25 is described. However, the tilt detection mechanism 218 may be a portion of the outboard motor 25. For example, in a case where a pulse motor and a hydraulic cylinder including a position detecting mechanism are adopted as actuators to turn the outboard motor 25 around the tilt/trim shaft 210, a tilting state of the outboard motor 25 may be detected based on signals input from these devices into the control device 223.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The present application corresponds to Japanese Patent Application No. 2009-250174 filed in Japan Patent Office on Oct. 30, 2009 and Japanese Patent Application No. 2009-082053 filed in Japan Patent Office on Mar. 30, 2009, the entire disclosures of which are incorporated herein by reference.

What is claimed is:

1. A marine vessel comprising:

an outboard motor mounting portion provided at a stern of a hull;

a platform provided rearward of the outboard motor mounting portion; and an outboard motor mounted to the outboard motor mounting portion and configured to be tilted with respect to the hull around a horizontal axis from a tilting origin position to a maximum tilt position; wherein when the outboard motor is at the maximum tilt position, a lower portion of the outboard motor is located above the platform; and the platform is located rearward of the outboard motor when the outboard motor is at the tilting origin position.

2. The marine vessel according to claim 1, further comprising a level difference provided between a deck of the hull and the platform, the level difference arranged such that the deck is positioned higher than the platform.

3. The marine vessel according to claim 1, wherein the platform includes a notched hole rearward of the outboard motor and penetrating vertically through the platform, and the lower portion of the outboard motor extends through the notched hole to a position above the platform.

4. A marine vessel comprising:

an outboard motor mounting portion provided at a stern of a hull;

a platform provided rearward of the outboard motor mounting portion;

an outboard motor mounted to the outboard motor mounting portion and configured to be tilted with respect to the hull around a horizontal axis from a tilting origin position to a maximum tilt position; and a ceiling portion that is disposed above the outboard motor and covers the outboard motor; wherein when the outboard motor is at the maximum tilt position, a lower portion of the outboard motor is located above the platform.

5. The marine vessel according to claim 3, further comprising:

a hatch that closes the notched hole; and a joint member that joins the hatch to the platform in such a manner that the hatch is openable.

6. The marine vessel according to claim 5, wherein the hatch is arranged such that at least a portion of an upper surface of the hatch is flush with an upper surface of the platform in a state in which the hatch is closed.

7. The marine vessel according to claim 5, further comprising:

a tilt detection mechanism that detects a tilting state of the outboard motor;

an opening/closing sensor that detects opening/closing of the hatch; and a control device that receives detection values of the tilt detection mechanism and the opening/closing sensor and controls the outboard motor based on the detection values; wherein the control device is programmed to stop turning of the outboard motor when the lower portion of the outboard motor reaches a position adjacent to the notched hole in a state in which the hatch is not opened and the lower portion of the outboard motor is moved upward by turning the outboard motor.

8. A marine vessel comprising:

an outboard motor mounting portion provided at a stern of a hull;

a platform provided rearward of the outboard motor mounting portion;

an outboard motor locating hole disposed at the stern of the hull; and an outboard motor located in the outboard motor locating hole, mounted to the outboard motor mounting portion, and configured to be tilted with respect to the hull around a horizontal axis from a tilting origin position to a maximum tilt position; wherein when the outboard motor is at the maximum tilt position, a lower portion of the outboard motor is located above the platform.

9. A marine vessel comprising:

an outboard motor mounting portion provided at a stern of a hull;

a platform provided rearward of the outboard motor mounting portion;

an outboard motor mounted to the outboard motor mounting portion and configured to be tilted with respect to the hull around a horizontal axis from a tilting origin position to a maximum tilt position; and a recess portion provided in the hull and into which an upper portion of the outboard motor enters when the outboard motor is tilted up; wherein when the outboard motor is at the maximum tilt position, a lower portion of the outboard motor is located above the platform.

* * * * *